US011230105B2

(12) United States Patent
Fujii et al.

(10) Patent No.: US 11,230,105 B2
(45) Date of Patent: Jan. 25, 2022

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventors: Hirokazu Fujii, Shiojiri (JP); Kazuyoshi Mizuno, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/061,817

(22) Filed: Oct. 2, 2020

(65) Prior Publication Data

US 2021/0101386 A1 Apr. 8, 2021

(30) Foreign Application Priority Data

Oct. 2, 2019 (JP) ..... JP2019-181983

(51) Int. Cl.
*B41J 2/165* (2006.01)

(52) U.S. Cl.
CPC ..... *B41J 2/16517* (2013.01); *B41J 2/16535* (2013.01); *B41J 2/16538* (2013.01)

(58) Field of Classification Search
CPC ..... B41J 2/16517; B41J 2/16535; B41J 2/16538; B41J 2/16508; B41J 2/16526
See application file for complete search history.

(56) References Cited

U.S. PATENT DOCUMENTS

2003/0218654 A1* 11/2003 Wouters ..... B41J 2/16544 347/33
2007/0165063 A1 7/2007 Horie
2008/0186352 A1 8/2008 Sasayama
2013/0241995 A1 9/2013 Maruyama
2018/0162120 A1 6/2018 Matsuoka

FOREIGN PATENT DOCUMENTS

CN 107150505 B * 1/2019 ..... B41J 2/16532
JP H10-151768 A 6/1998
JP 2003-341078 A 12/2003
JP 2006-212870 A 8/2006
JP 2007-130638 A 5/2007
JP 2007-190818 A 8/2007
JP 2008-188930 A 8/2008
JP 2009-137210 A 6/2009
JP 2013-188964 A 9/2013
JP 2015-020407 A 2/2015
(Continued)

*Primary Examiner* — Geoffrey S Mruk
(74) *Attorney, Agent, or Firm* — Workman Nydegger

(57) ABSTRACT

A liquid ejecting apparatus includes: a liquid ejecting portion configured to eject a liquid from a plurality of nozzles that are arranged on a nozzle surface to form a nozzle row; a plate-shaped member having an upper end portion of which a dimension in a direction in which the nozzle row extends is equal to or larger than that of the nozzle row; a wiping member configured to wipe the nozzle surface; and a control portion performing a contact operation of bringing the liquid bulging from the nozzle into contact with the upper end portion, and performing a wiping operation of wiping the nozzle surface after the contact operation by relatively moving the wiping member and the liquid ejecting portion in a wiping direction along the nozzle surface.

10 Claims, 12 Drawing Sheets

(56) References Cited

FOREIGN PATENT DOCUMENTS

| | | | |
|---|---|---|---|
| JP | 2015-168192 | A | 9/2015 |
| JP | 2018-094743 | A | 6/2018 |
| JP | 2018-122533 | A | 8/2018 |
| JP | 2019-025769 | A | 2/2019 |
| JP | 2019-072929 | A | 5/2019 |

* cited by examiner

LIQUID EJECTING APPARATUS AND MAINTENANCE METHOD OF LIQUID EJECTING APPARATUS

The present application is based on, and claims priority from JP Application Serial Number 2019-181983, filed Oct. 2, 2019, the disclosure of which is hereby incorporated by reference herein in its entirety.

BACKGROUND

1. Technical Field

The present disclosure relates to a liquid ejecting apparatus such as a printer and a maintenance method of the liquid ejecting apparatus.

2. Related Art

For example, JP-A-2003-341078 discloses a printer that is an example of a liquid ejecting apparatus for performing printing by using ink, which is an example of a liquid, from a printer head, which is an example of a liquid ejecting portion, having a nozzle. After purging, the printer skims the printer head by a skimmer which is an example of a plate-shaped member. At this time, the printer is brought into contact with ink droplets hung down from a surface of the printer head, which is an example of a nozzle surface, but the skimmer is moved along the surface of the printer head so as not to bring it into contact with the printer head.

When a liquid bulging from the nozzle is brought into contact with a plate-shaped member that relatively moves with a liquid ejecting portion in a direction along the nozzle surface, pressure fluctuation occurs in the liquid in the liquid ejecting portion, which may cause the liquid adhering to the liquid ejecting portion to be drawn into the liquid ejecting portion from the nozzle. When foreign matters or air bubbles are infiltrated into the nozzle together with the liquid, excellent ejection performance of ejecting the liquid from the nozzle cannot be maintained.

SUMMARY

According to an aspect of the present disclosure, there is provided a liquid ejecting apparatus including: a liquid ejecting portion configured to eject a liquid to be supplied from a plurality of nozzles that are arranged on a nozzle surface to form a nozzle row; a plate-shaped member having an upper end portion of which a dimension in a direction in which the nozzle row extends is equal to or larger than that of the nozzle row; a wiping member configured to wipe the nozzle surface; and a control portion, in which the control portion performs a contact operation of bringing the liquid bulging from the nozzle into contact with the upper end portion so that a direction in which the liquid bulging from the nozzle is brought closer to the upper end portion is a gravity direction in a state where a nozzle peripheral region including the nozzles on the nozzle surface is not in contact with the upper end portion, and maintaining the contact state between the liquid bulging from the nozzle and the upper end portion for a predetermined time without relatively moving the liquid ejecting portion and the plate-shaped member, and performs a wiping operation of wiping the nozzle surface after the contact operation by relatively moving the wiping member and the liquid ejecting portion in a wiping direction along the nozzle surface.

According to another aspect of the present disclosure, there is provided a maintenance method of a liquid ejecting apparatus including a liquid ejecting portion configured to eject a liquid to be supplied from a plurality of nozzles that are arranged on a nozzle surface to form a nozzle row, a plate-shaped member having an upper end portion of which a dimension in a direction in which the nozzle row extends is equal to or larger than that of the nozzle row, and a wiping member configured to wipe the nozzle surface, the maintenance method including: performing a contact operation of bringing the liquid bulging from the nozzle into contact with the upper end portion so that a direction in which the liquid bulging from the nozzle is brought closer to the upper end portion is a gravity direction in a state where a nozzle peripheral region including the nozzles on the nozzle surface is not in contact with the upper end portion, and maintaining the contact state between the liquid bulging from the nozzle and the upper end portion for a predetermined time without relatively moving the liquid ejecting portion and the plate-shaped member; and performing a wiping operation of wiping the nozzle surface after the contact operation by relatively moving the wiping member and the liquid ejecting portion in a wiping direction along the nozzle surface.

DESCRIPTION OF EXEMPLARY EMBODIMENTS

Figure 1:
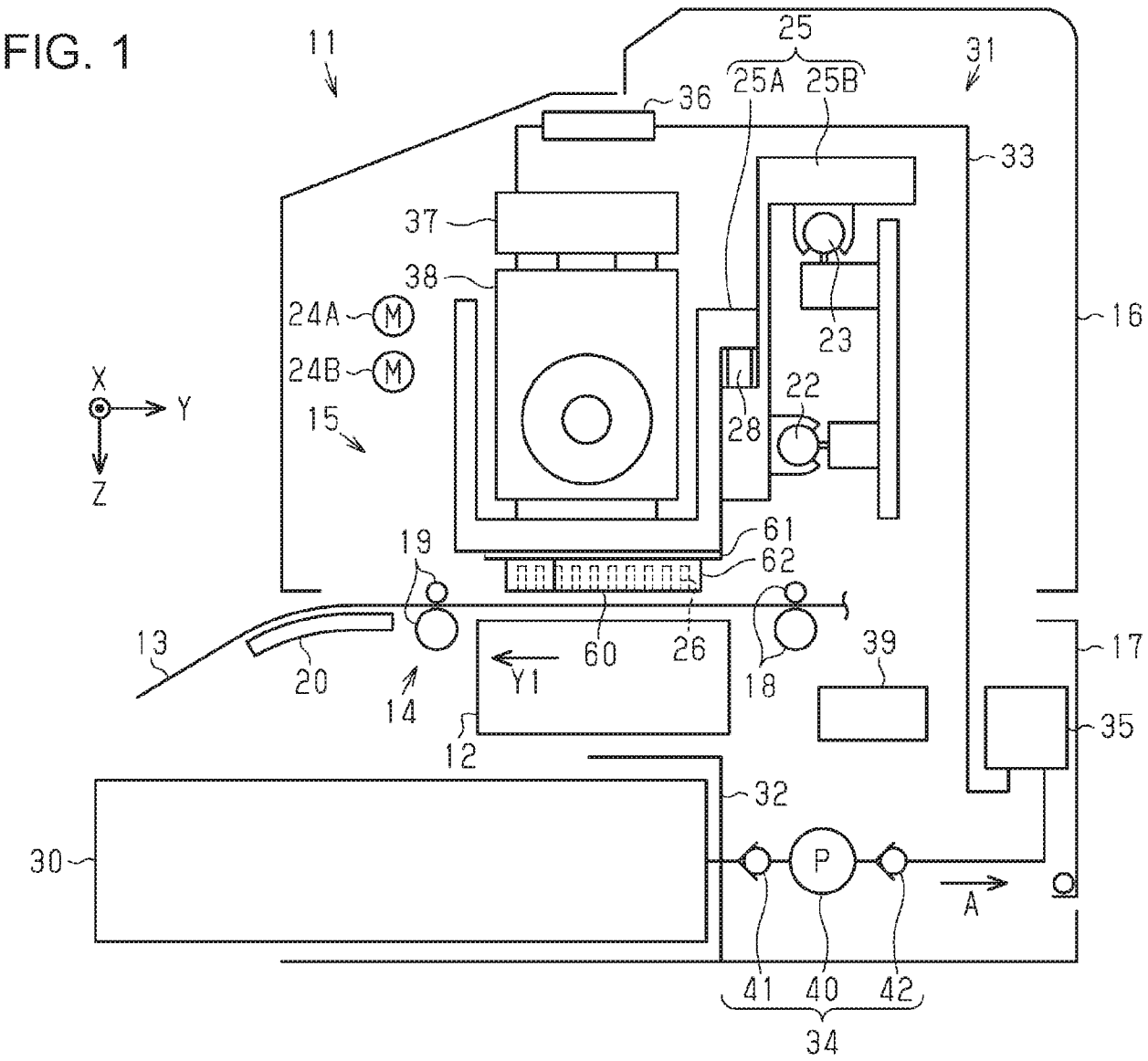
FIG. 1 is a schematic view illustrating a schematic configuration of a liquid ejecting apparatus according to an embodiment.

Hereinafter, an embodiment of a liquid ejecting apparatus and a maintenance method of the liquid ejecting apparatus will be described with reference to the drawings. The liquid ejecting apparatus is, for example, an ink jet printer that ejects ink, which is an example of a liquid, to a medium such as paper to perform printing.

In the drawings, a gravity direction in which a liquid ejecting apparatus 11 is placed on a horizontal plane indicates a Z axis, and directions along the horizontal plane indicate an X axis and a Y axis, respectively. The X axis, the Y axis, and the Z axis are orthogonal to each other. In the following description, a direction in parallel to the X axis is referred to as an intersecting direction X, a direction in parallel to the Y axis is referred to as a wiping direction Y, and a direction in parallel to the Z axis is referred to as a gravity direction Z.

As illustrated in FIG. 1, the liquid ejecting apparatus 11 includes a transport portion 14 that transports a medium 13 supported by a support table 12 in a transport direction Y1 along a surface of the support table 12, and a printing portion 15 that ejects a liquid to the transported medium 13 to perform printing. The transport direction Y1 is a direction along a transport path of the medium 13, and is a direction in parallel to the Y axis at a printing position where the printing portion 15 performs printing on the medium 13.

The support table 12, the transport portion 14, and the printing portion 15 are assembled to a main body 16 constituted by a housing, a frame, or the like. In the liquid ejecting apparatus 11, the support table 12 extends in a width direction of the medium 13. The width direction of the medium 13 is also a direction in parallel to the X axis. A cover 17 is attached openably/closably to the main body 16.

The transport portion 14 includes, in the transport direction Y1, a pair of upstream transport rollers 18 that are arranged upstream of the support table 12, a pair of downstream transport rollers 19 that is arranged at an downstream of the support table 12, and a guide plate 20 that is arranged at a downstream of the pair of downstream transport rollers 19. The transport portion 14 includes a transport motor 24A that rotates the pair of upstream transport rollers 18 and the pair of downstream transport rollers 19. The pair of upstream transport rollers 18 and the pair of downstream transport rollers 19 transport the medium 13 along the surface of the support table 12 and a surface of the guide plate 20 by rotating with the medium 13 being held therebetween. The guide plate 20 guides the medium 13 while supporting the medium 13 by the support table 12.

The printing portion 15 includes a first guide shaft 22 and a second guide shaft 23 that are parallel to each other, and a carriage 25 that is guided by the first guide shaft 22 and the second guide shaft 23 and reciprocatively movable along the X axis. The carriage 25 has a carriage base 25B that moves along with driving of a carriage motor 24B, and a carriage body 25A that can move along the Z axis by a moving mechanism 28 including a cam, and the like. The carriage body 25A vertically moves with respect to the carriage base 25B, such that a distance between the carriage body 25A and the support table 12 in the gravity direction Z changes.

The liquid ejecting apparatus 11 includes a liquid ejecting portion 60 that can eject a liquid to be supplied from a plurality of nozzles 26. The liquid ejecting portion 60 is attached to a lower end portion of the carriage body 25A. The liquid ejecting apparatus 11 may include a plurality of liquid ejecting portions 60. The liquid ejecting apparatus 11 of the present embodiment includes four liquid ejecting portions 60. A lower surface of each of the liquid ejecting portions 60 is attached to the carriage 25 in such a manner that the lower surface thereof can face the support table 12 at a predetermined interval in the gravity direction Z. The liquid ejecting portion 60 reciprocates along the X axis together with the carriage 25.

The liquid ejecting apparatus 11 includes a supply mechanism 31 that supplies a liquid from a liquid storage 30 storing the liquid to the liquid ejecting portion 60, and a attaching portion 32 in which the liquid storage 30 is attached. The liquid ejecting apparatus 11 may include a plurality of supply mechanisms 31 and supply a plurality of types of liquid to the liquid ejecting portion 60. The type of liquid is, for example, a color. The liquid ejecting apparatus 11 of the present embodiment ejects cyan, magenta, yellow, and black ink to perform color printing on the medium 13.

The supply mechanism 31 includes a supply path 33 that supplies the liquid from the liquid storage 30 to the liquid ejecting portion 60. The supply path 33 is provided with, in order from the upstream in a supply direction A of the liquid, a supply pump 34 that causes the liquid to flow, a filter unit 35 that captures air bubbles or foreign matters in the liquid, a static mixer 36 that stirs the liquid by changing the flow of the liquid on the supply path 33, a liquid retaining chamber 37 that retains the liquid, and a pressure adjustment unit 38 that adjusts a pressure of the liquid.

The supply pump 34 may have a diaphragm pump 40 of a pump chamber having a variable volume, an inlet valve 41 arranged at an upstream of the diaphragm pump 40, and a discharge valve 42 arranged at a downstream of the diaphragm pump 40. The inlet valve 41 and the discharge valve 42 allow the liquid to flow from the upstream to the downstream, but are configured by one direction valve that inhibits the flow of the liquid from the downstream to the upstream.

The supply pump 34 sucks the liquid via the inlet valve 41 from the liquid storage 30 as the volume of the pump chamber of the diaphragm pump 40 increases. The supply pump 34 discharges the liquid toward the liquid ejecting portion 60 via the discharge valve 42 as the volume of the pump chamber of the diaphragm pump 40 decreases. The filter unit 35 is arranged at a position corresponding to the cover 17 of the main body 16 and is detachably attached to the supply path 33. The filter unit 35 can be replaced by opening the cover 17.

The liquid ejecting apparatus 11 includes a control portion 39 that controls various operations executed by the liquid ejecting apparatus 11. The control portion 39 is composed of, for example, a processing circuit including a computer and a memory. The control portion 39 controls the transport motor 24A, the carriage motor 24B, the supply pump 34, the liquid ejecting portion 60, the moving mechanism 28, the pressure adjustment unit 38, and the like according to a program stored in the memory. The control portion 39 vertically moves the carriage body 25A by operating the moving mechanism 28.

Figure 2:
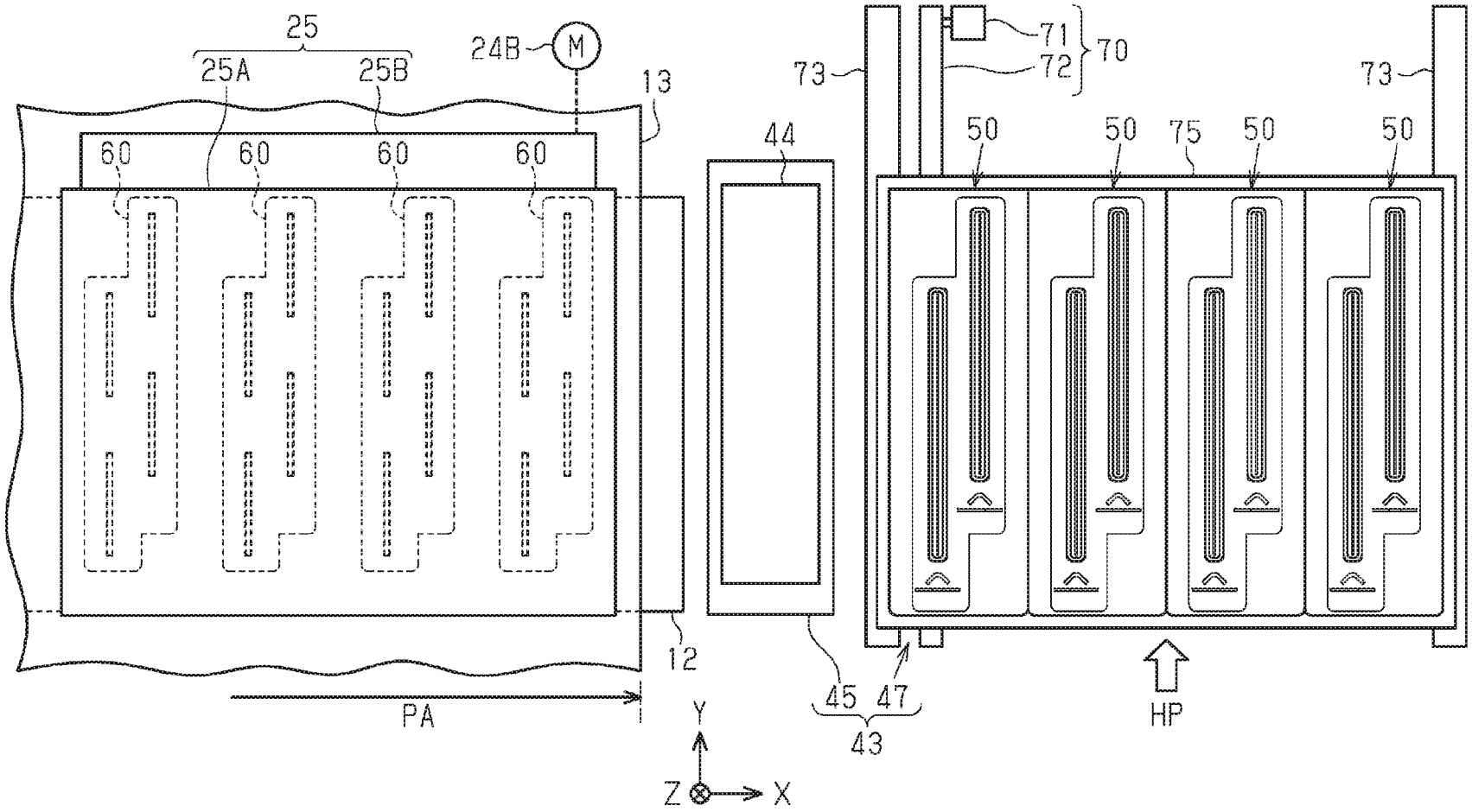
FIG. 2 is a schematic plan view illustrating a positional relationship between a support table for a medium and a maintenance mechanism.

As illustrated in FIG. 2, the liquid ejecting portions 60 are installed in the intersecting direction X at predetermined intervals from each other. When printing is not performed or when power is turned off, the carriage body 25A and the liquid ejecting portion 60 stand by at a home position HP. A region of the support table 12 where the medium 13 to be transported is supported is a transport region PA. When the printing is performed, the liquid ejecting portion 60 moves to the transport region PA.

The liquid ejecting apparatus 11 includes a maintenance mechanism 43 for performing maintenance on the liquid ejecting portion 60. The maintenance mechanism 43 includes a flushing unit 45 having a liquid receiving portion 44 and a cleaning mechanism 47.

The flushing unit 45 receives the liquid to be ejected by the liquid receiving portion 44 when so-called flushing which ejects the liquid from each nozzle 26 is performed regardless of printing, in order to prevent or eliminate clogging of each nozzle 26, or the like.

The cleaning mechanism 47 includes a unit holder 75 and a maintenance unit 50 attached to the unit holder 75. The cleaning mechanism 47 of the present embodiment includes four maintenance units 50 that maintain the four liquid ejecting portions 60, respectively. The cleaning mechanism 47 includes a pair of guide frames 73 and a holder driving portion 70. The pair of guide frames 73 is provided to sandwich the unit holder 75 and extend in the wiping direction Y. The unit holder 75 reciprocates along the Y axis by driving the holder driving portion 70.

Figure 3:
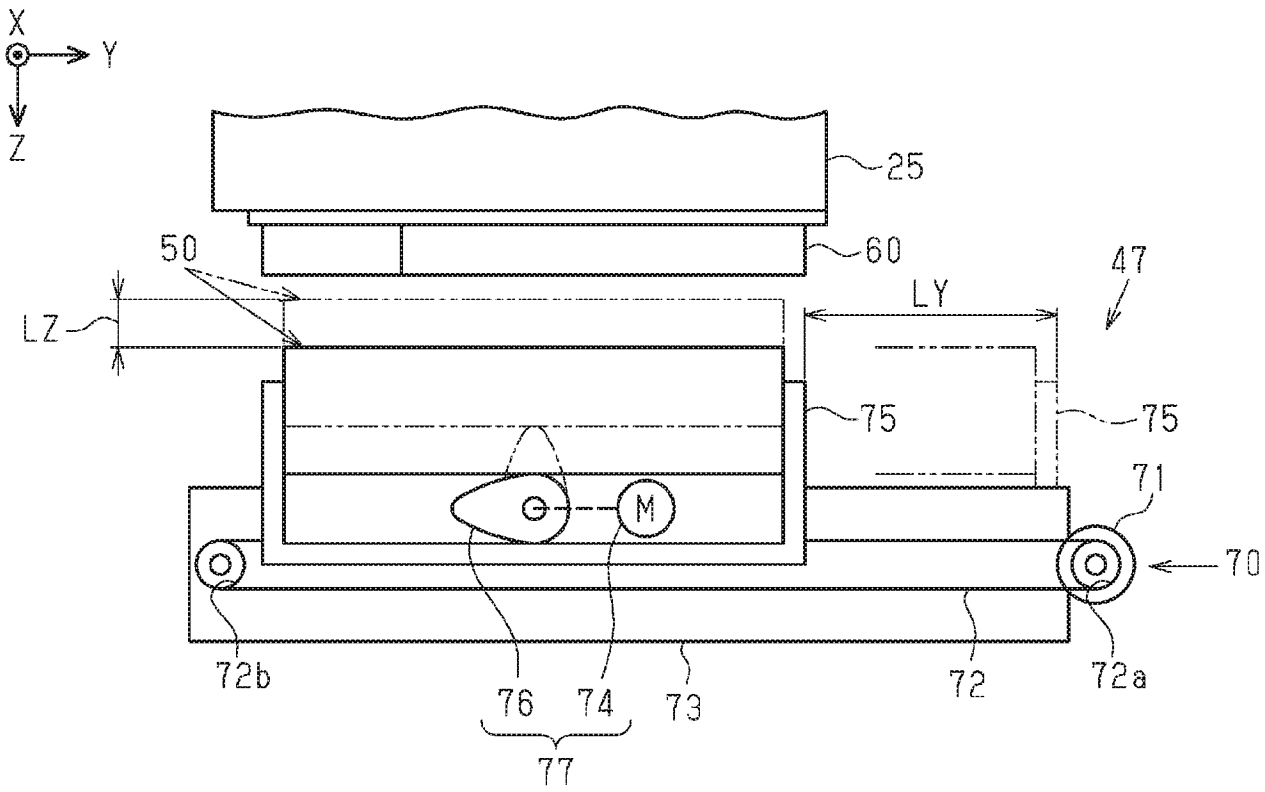
FIG. 3 is a schematic view illustrating a schematic configuration of a maintenance unit of the maintenance mechanism.

As illustrated in FIGS. 2 and 3, the holder driving portion 70 includes an electric motor 71 as a power source, a driving pulley 72*a*, a driven pulley 72*b*, and a belt 72 stretched between the driving pulley 72*a* and the driven pulley 72*b*. A part of the belt 72 is fixed to the unit holder 75. The driving pulley 72*a*, the driven pulley 72*b*, and the belt 72 constitute a power transmission mechanism that transmits power of the electric motor 71 to the unit holder 75.

The driving pulley 72*a* is directly coupled to the electric motor 71. Therefore, the driving pulley 72*a* is rotated by the rotational drive of the electric motor 71. The belt 72 revolves by the rotation of the driving pulley 72*a*. The unit holder 75 reciprocates in the wiping direction Y and in a direction opposite to the wiping direction Y with the revolving of the belt 72 while being guided by the guide frame 73.

The control portion 39 also controls the driving of the electric motor 71. When the control portion 39 drives the electric motor 71 to normally rotate, the unit holder 75 moves, in the wiping direction Y, the electric motor 71 from a wiping start position indicated by the solid line in FIG. 3 to a wiping end position indicated by an alternate long and two short dashed line in FIG. 3. When the unit holder 75 moves forward to the wiping end position, the control portion 39 stops the rotation of the electric motor 71. When the control portion 39 drives the electric motor 71 to inversely rotate, the unit holder 75 moves backward from the wiping end position to the wiping start position. The unit holder 75 of the present embodiment can reciprocate over a distance of the first length LY in the wiping direction Y.

As illustrated in FIG. 3, the cleaning mechanism 47 of the present embodiment includes a unit driving portion 77 that moves the maintenance unit 50 to slide vertically to the unit holder 75 along the Z axis. The unit driving portion 77 has an eccentric cam 76 provided in the unit holder 75, and a driving motor 74 rotating the eccentric cam 76. The eccentric cam 76 is provided so as to be in contact with the maintenance unit 50 from below.

When the eccentric cam 76 rotates, the maintenance unit 50 vertically moves along an inner surface of the unit holder 75. As a result, the maintenance unit 50 changes a distance between the maintenance unit 50 and the liquid ejecting portion 60. The maintenance unit 50 can vertically move between the position indicated by the solid line in FIG. 3 and the position indicated by the alternate long and two short dashed line in FIG. 3 over a distance of a second length LZ. The control portion 39 also controls the drive of the driving motor 74.

Figure 4:
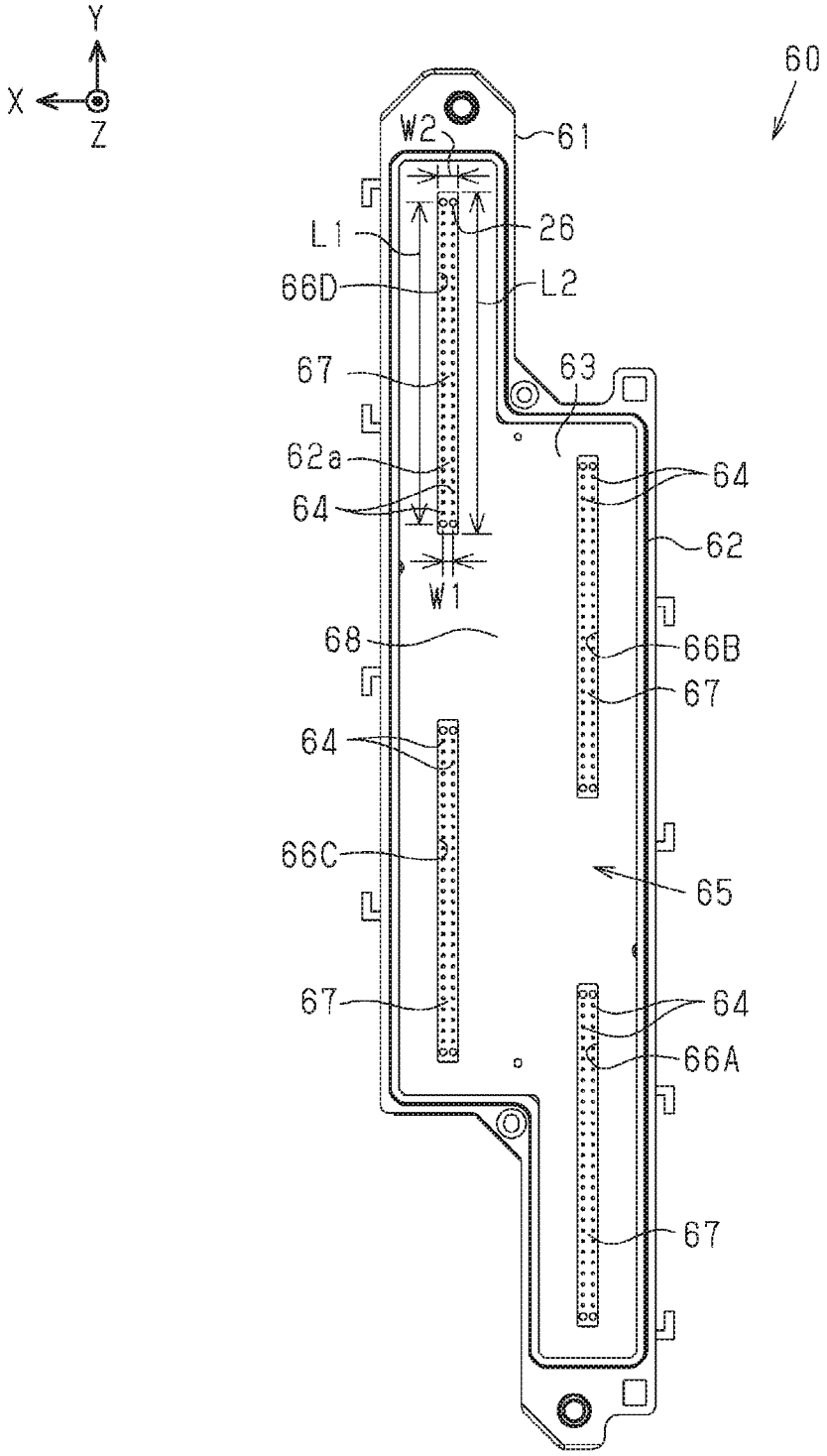
FIG. 4 is a plan view of a liquid ejecting portion including a nozzle that ejects a liquid.

As illustrated in FIGS. 1 and 4, the liquid ejecting portion 60 includes a bracket portion 61 for attachment to the carriage 25, a nozzle forming member 62 in which the nozzles 26 are formed, and a plate-shaped cover member 63 fixed to the nozzle forming member 62. The nozzle forming member 62 has a nozzle opening surface 62*a* having the nozzle 26 opened, the nozzle 26 constituting a nozzle row 64 arranged in row. The intersecting direction X is a direction intersecting with the nozzle row 64. The cover member 63 covers a part of the nozzle opening surface 62*a*. The cover member 63 may have through-holes. The cover member 63 of the present embodiment has a first through-hole 66A, a second through-hole 66B, a third through-hole 66C, and a fourth through-hole 66D.

Each of the first through-hole 66A to the fourth through-hole 66D exposes two nozzle rows 64. A first dimension L1 in the wiping direction Y of the nozzle row 64 exposed from one of the first through-hole 66A to the fourth through-hole 66D is smaller than a second dimension L2 which is a dimension of one of the first through-hole 66A to the fourth through-hole 66D.

The two nozzle rows 64 are arranged in the intersecting direction X by a first width W1. A second width W2, which is the dimension of the first through-hole 66A to the fourth through-hole 66D in the intersecting direction X, is larger than the first width W1. The through-holes may be provided in the cover member 63 for each nozzle row 64. The cover member 63 is manufactured by processing a metal plate into a predetermined shape. Examples of the metal forming the cover member 63 include stainless steel.

In the present embodiment, the first through-hole 66A and the second through-hole 66B are arranged side by side in the wiping direction Y and have a predetermined interval in the wiping direction Y. The nozzle opening surface 62*a* is provided with the nozzle row 64 exposed in the first through-hole 66A and the nozzle row 64 exposed in the second through-hole 66B in a state where the nozzle row 64 exposed in the first through-hole 66A and the nozzle row 64 exposed in the second through-hole 66B are arranged in row in the wiping direction Y. The third through-hole 66C and the fourth through-hole 66D are arranged side by side in the wiping direction Y and have a predetermined interval in the wiping direction Y. The nozzle opening surface 62*a* is provided with the nozzle row 64 exposed in the third through-hole 66C and the nozzle row 64 exposed in the fourth through-hole 66D so as to be arranged in row in the wiping direction Y.

The first through-hole 66A or the second through-hole 66B and the third through-hole 66C or the fourth through-hole 66D are arranged with a predetermined interval in the intersecting direction X. The third through-hole 66C is arranged at an intermediate position between the first through-hole 66A and the second through-hole 66B in the wiping direction Y, and the second through-hole 66B is arranged at an intermediate position between the third through-hole 66C and the fourth through-hole 66D in the wiping direction Y. The nozzle row 64 exposed in the third through-hole 66C is provided with the nozzle opening surface 62*a* in a state where the nozzle row 64 exposed in the third through-hole 66C overlap the nozzle row 64 exposed in the first through-hole 66A and the nozzle row 64 exposed in the second through-hole 66B, when viewed from one side in the intersecting direction X. The nozzle row 64 exposed in the second through-hole 66B is provided with the nozzle opening surface 62*a* in a state where the nozzle row 64 exposed in the second through-hole 66B overlap the nozzle row 64 exposed in the third through-hole 66C and the nozzle row 64 exposed in the fourth through-hole 66D, when viewed from the other side in the intersecting direction X.

In the present embodiment, a region exposed by the first through-hole 66A to the fourth through-hole 66D of the cover member 63 in the nozzle opening surface 62*a* is a nozzle peripheral region 67 including an opening region of each nozzle 26. That is, the cover member 63 has the first through-hole 66A to the fourth through-hole 66D for exposing the nozzle peripheral region 67.

In the present embodiment, the cover member 63 is fixed to the liquid ejecting portion 60 in a state where the cover member 63 covers a portion of the nozzle opening surface 62*a* other than the nozzle peripheral region 67 exposed by the first through-hole 66A to the fourth through-hole 66D. Therefore, a bottom surface of the cover member 63 has a shape in which two rectangular shapes whose longitudinal direction is the wiping direction Y substantially deviates from each other in the wiping direction Y. The four nozzle peripheral regions 67 exposed by the first through-hole 66A to the fourth through-hole 66D and the lower surface of the cover member 63 in the gravity direction Z, that is, the entire bottom surface of the liquid ejecting portion 60 are a nozzle surface 65.

The lower surface of the cover member 63 is formed with an outer region 68 surrounding the nozzle peripheral region 67. Therefore, the nozzle surface 65 includes the nozzle peripheral region 67 and the outer region 68. The outer region 68 is a protruding surface protruding from the nozzle peripheral region 67 in the gravity direction Z by a thickness of the cover member 63. Since the cover member 63 of the present embodiment has a thickness dimension of 0.1 mm, there is a step having a dimension of 0.1 mm between the nozzle peripheral region 67 and the outer region 68. That is, the nozzle surface 65 is formed by an uneven surface that becomes a concave portion in a portion of the nozzle peripheral region 67 and a convex portion in a portion of the outer region 68.

As illustrated in FIG. 4, the nozzle row 64 includes a large number of nozzles 26 arranged at a constant pitch on the nozzle opening surface 62*a*. The plurality of nozzles 26 are arranged in the wiping direction Y. In other words, the wiping direction Y is a direction along the nozzle row 64 and also a direction in which the nozzle row 64 extends. In one nozzle row 64, the liquid stored in one liquid storage 30 is ejected. The liquid ejected by the nozzle 26 is not limited to ink of four colors of cyan, magenta, yellow, and black, but the ink of colors such as light magenta, light cyan, light yellow, ash, orange, and white may be ejected. The liquid ejecting portion 60 may eject the ink of three colors of cyan, magenta, and yellow, or may eject ink of one color such as black. In the nozzle row 64, there may be an unused nozzle having the liquid not being ejected.

The liquid used in the present embodiment is, for example, pigment ink. In the pigment ink, many pigment particles are dispersed in the liquid used as a dispersion medium thereof. When the ink is aqueous pigment ink, many pigment particles are dispersed in water which is a dispersion medium. As the cyan, magenta, and yellow pigments, organic pigments having an average particle diameter of substantially 100 nm are used. As the black pigment, an inorganic pigment having an average particle diameter of substantially 120 nm is used. Examples of the inorganic pigment include carbon black.

A liquid-repellent film is formed on the surfaces of the nozzle opening surface 62*a* and the cover member 63 by being subjected to a liquid-repellent treatment for easily repelling a liquid. Therefore, liquid repellency is high in the nozzle peripheral region 67 and the outer region 68 that form the nozzle surface 65. The liquid-repellent film of the present embodiment is a water-repellent film having a function of repelling an aqueous liquid. The liquid-repellent film may be formed of, for example, a thin film base layer whose main material is polyorganosiloxane having an alkyl group, and a liquid-repellent film layer made of metal alkoxide having a long chain polymer group containing fluorine. The liquid-repellent film may be a liquid-repellent coating film or a liquid-repellent monomolecular film. A thickness of the liquid-repellent film and the liquid-repellent treatment method can be selected optionally. In the present embodiment, the liquid-repellent treatment is not applied to a stepped portion formed by the thickness of the cover member 63 between the nozzle peripheral region 67 and the outer region 68.

Next, a configuration of the maintenance unit 50 that maintains the liquid ejecting portion 60 will be described. In the present embodiment, each of the four maintenance units 50 provided in the unit holder 75 has the same configuration.

Figure 5:
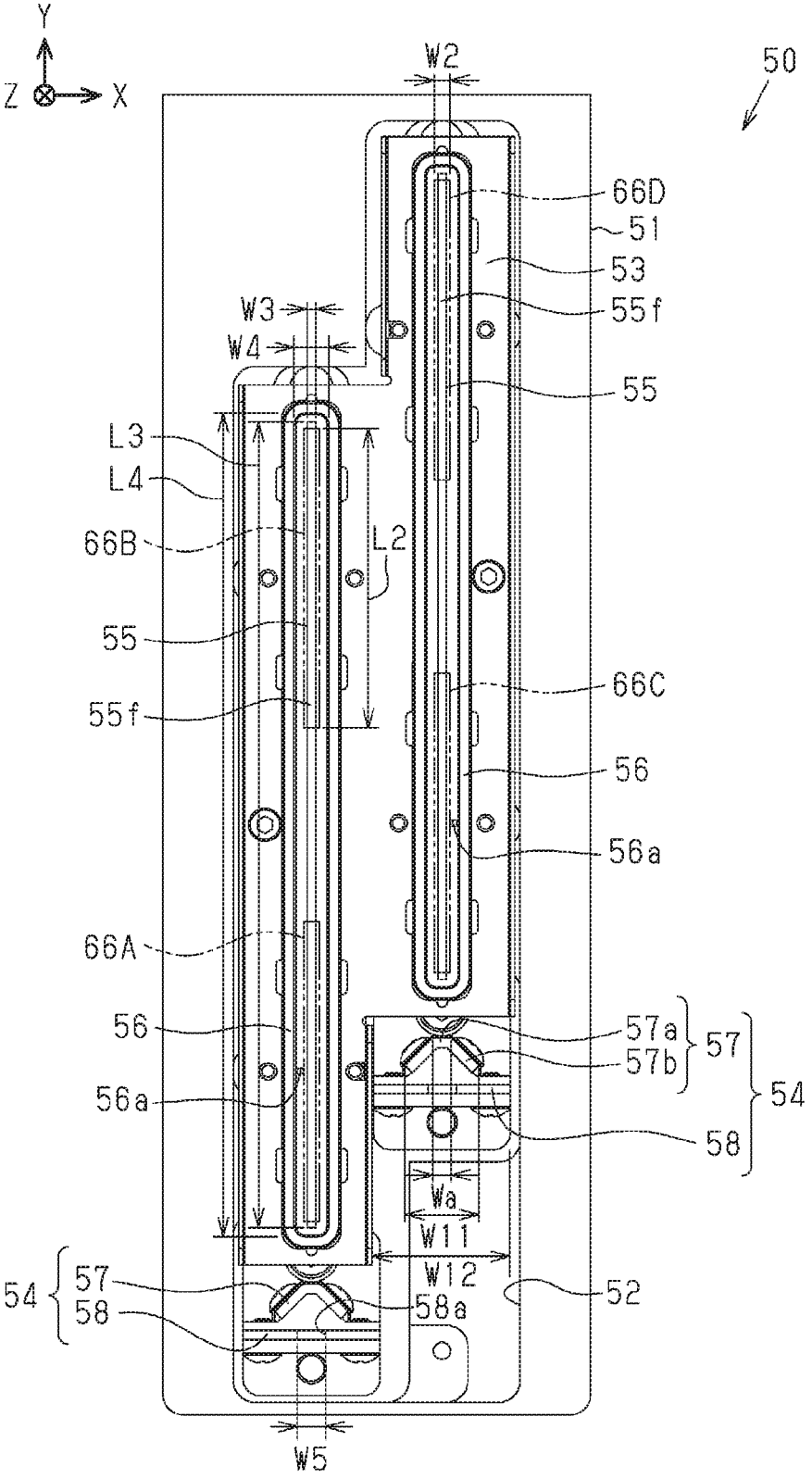
FIG. 5 is a plan view of the maintenance unit.
Figure 6:
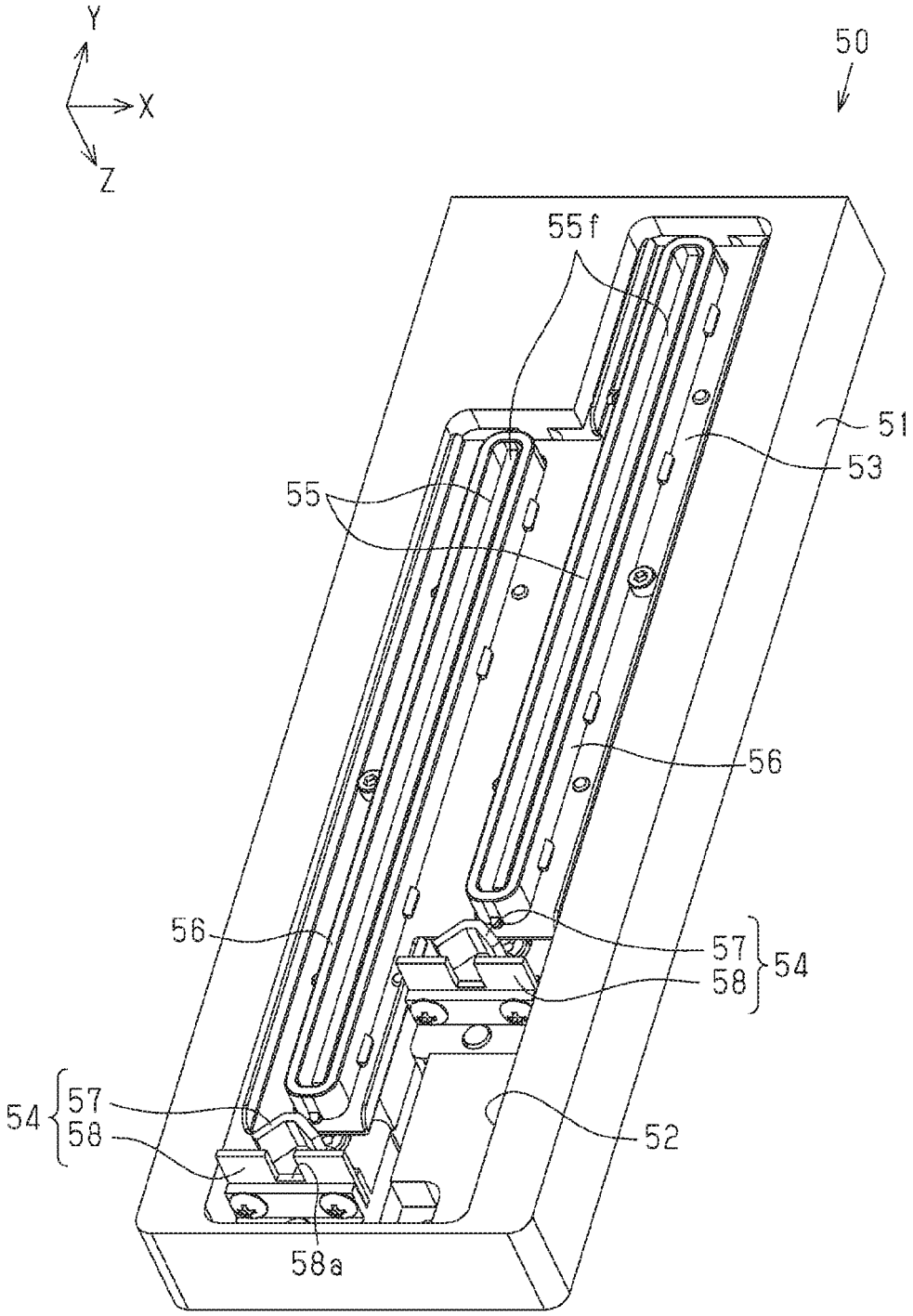
FIG. 6 is a perspective view of the maintenance unit.

As illustrated in FIGS. 5 and 6, the maintenance unit 50 includes a unit frame body 51 of a bottomed box shape having a unit hole portion 52 opened upward. The maintenance unit 50 includes a fixing plate 53, a plate-shaped member 55, a wiping member 54 that can wipe the nozzle surface 65, and a cap 56 that surrounds the plate-shaped member 55. A discharge port 56*a* for discharging the received liquid may be provided on a bottom surface of the cap 56. The discharge port 56*a* may penetrate the fixing plate 53 and the unit frame body 51. The plate-shaped member 55 and the wiping member 54 are accommodated in the unit hole portion 52 side by side in the wiping direction Y. A shape of the unit hole portion 52 is larger than that of the nozzle surface 65. Therefore, in a state where the liquid ejecting portion 60 faces the maintenance unit 50, the nozzle surface 65 is located in the unit hole portion 52 when viewed from above.

The plate-shaped member 55 is formed of a nonabsorbent member that does not absorb a liquid. Examples of the nonabsorbent member include metal such as stainless steel. The plate-shaped member 55 has an upper end portion 55*f* of a rectangular flat shape. The cap 56 has an elliptical upper end and is formed in a tubular shape with a side wall extending in the gravity direction Z. The cap 56 is fixed to the unit frame body 51 via a fixing plate 53 provided in the unit hole portion 52.

The maintenance unit 50 may include a plurality of sets of the wiping member 54, the plate-shaped member 55, and the cap 56. The maintenance unit 50 of the present embodiment includes two sets of the wiping member 54, the plate-shaped member 55, and the cap 56. One plate-shaped member 55 corresponds to the nozzle row 64 exposed from the first through-hole 66A and the second through-hole 66B. The other plate-shaped member 55 corresponds to the nozzle row 64 exposed from the third through-hole 66C and the fourth through-hole 66D. Specifically, in a state where the liquid ejecting portion 60 and the maintenance unit 50 face each other, the plate-shaped member 55 faces a portion where the upper end portion 55*f* is sandwiched between the corresponding two nozzle rows 64.

In the wiping direction Y, a third dimension L3 of the upper end portion 55*f* is larger than the total dimension of the first through-hole 66A and the second through-hole 66B and smaller than a fourth dimension L4 of the cap 56. The third dimension L3 of the plate-shaped member 55 in the wiping direction Y is equal to or larger than or equal to the first dimension L1 of the nozzle row 64. In the intersecting direction X, a third width W3 of the upper end portion 55*f* of the plate-shaped member 55 is smaller than a fourth width W4 of the cap 56 and smaller than the first width W1 between the two nozzle rows 64. The second width W2 of each of the first through-hole 66A to the fourth through-hole 66D is the same as a dimension of the nozzle peripheral region 67 in the intersecting direction X. The third width W3 of the upper end portion 55*f* is smaller than the second width W2 of each of the first through-hole 66A to the fourth through-hole 66D. Therefore, it can be said that the dimension of the upper end portion 55*f* intersecting with the nozzle row 64 in the intersecting direction X is smaller than the dimension of the nozzle peripheral region 67 in the intersecting direction X. In the present embodiment, the first width W1 between the two nozzle rows 64 is substantially 1 mm, the second width W2 of each of the first through-hole 66A to the fourth through-hole 66D is substantially 2 mm, and the third width W3 of the upper end portion 55*f* is 0.1 mm.

A surface of the plate-shaped member 55 including the upper end portion 55*f* may not be subjected to the liquid-repellent treatment. That is, the plate-shaped member 55 may have lower liquid repellency than the nozzle peripheral region 67 and the outer region 68 in which the liquid-repellent film is formed. Therefore, a contact angle formed by a surface of the liquid and the surface of the plate-shaped member 55 when the plate-shaped member 55 is brought into contact with the liquid is smaller than a contact angle formed by the surface of the liquid and the surface of the nozzle peripheral region 67 when the nozzle peripheral region 67 is brought into contact with the liquid.

As illustrated in FIGS. 5 and 6, the wiping member 54 includes a first wiping member 57 whose dimension in the intersecting direction X is a first wiping width W11 and a second wiping member 58 whose dimension in the intersecting direction X is a second wiping width W12. The first wiping width W11 is larger than the second width W2. The second wiping width W12 is larger than the first wiping width W11. That is, the dimension of the second wiping member 58 in the intersecting direction X is larger than the dimension of the first wiping member 57. The first wiping member 57 has a central region 57*a* located in the center thereof and end regions 57*b* located on both sides of the central region 57*a* in the intersecting direction X. The central region 57*a* protrudes forward the end region 57*b* in the wiping direction Y. The first wiping member 57 is located in front of the second wiping member 58 in the wiping direction Y.

In the first wiping member 57 of the present embodiment, the central region 57*a* has a flat plate shape extending in the intersecting direction X and has a central width Wa in the intersecting direction X. The end region 57*b* has a flat plate shape extending in a direction inclined with respect to the X axis and the Y axis so as to be inclined with respect to the central region 57*a*. The second wiping member 58 of the present embodiment has a non-contact region 58*a* having a notched upper end at the center thereof in the intersecting direction X. The non-contact region 58*a* has a rectangular shape when viewed from the wiping direction Y. A fifth width W5 of the non-contact region 58*a* in the intersecting direction X is larger than the third width W3 of the plate-shaped member 55 and larger than the second width W2 of each of the first through-hole 66A to the fourth through-hole 66D.

In the intersecting direction X, an intermediate position of the central region 57*a* substantially coincides with an intermediate position of the non-contact region 58*a*. In the intersecting direction X, the intermediate positions of the central region 57*a* and the non-contact region 58*a* substantially coincides with the intermediate position of the first through-hole 66A or the third through-hole 66C. The first wiping member 57 and the second wiping member 58 of the present embodiment are formed of thin plate-shaped rubber members.

Next, a maintenance operation of the liquid ejecting portion 60 by the maintenance unit 50 will be described together with an effect of the present embodiment. This maintenance operation includes a contact operation in which the liquid is pressurized and discharged from the nozzle 26 to bring it into contact with the plate-shaped member 55, and a wiping operation of performing after the contact operation. That is, after the contact operation, the control portion 39 performs the wiping operation of wiping the nozzle surface 65 by relatively moving the wiping member 54 and the liquid ejecting portion 60 in the wiping direction Y along the nozzle surface 65. The maintenance unit 50 performs the maintenance operation on the nozzle peripheral region 67 of the first through-hole 66A and the second through-hole 66B, and simultaneously performs the maintenance operation on the nozzle peripheral region 67 of the third through-hole 66C and the fourth through-hole 66D.

Figure 7:
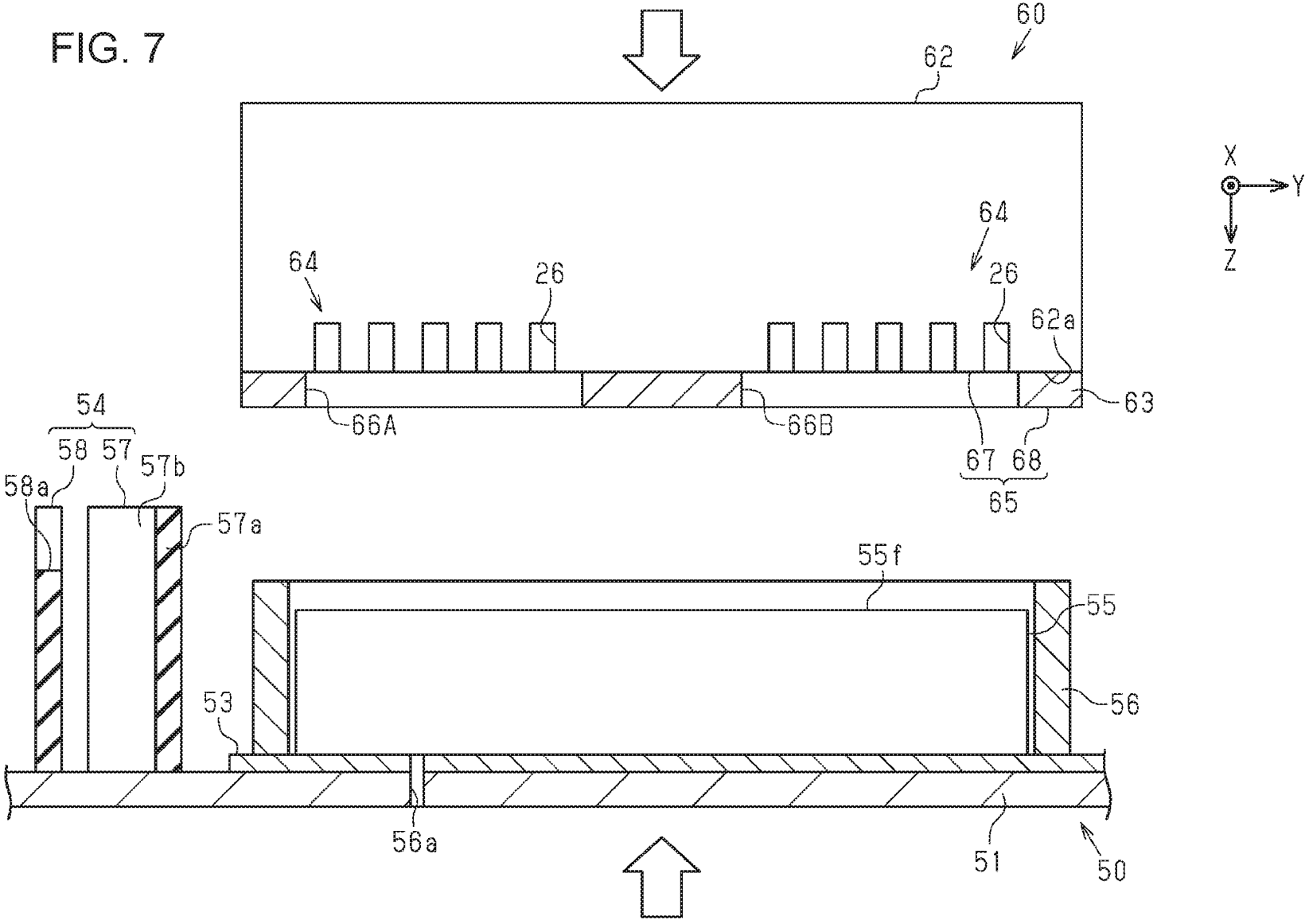
FIG. 7 is a schematic view illustrating a state where a maintenance operation starts.

As illustrated in FIG. 7, at the time of the maintenance operation, the contact operation of bringing the liquid bulging from the nozzle 26 into contact with the plate-shaped member 55 is performed first. The liquid ejecting portion 60 located at the home position HP faces the maintenance unit 50. At this time, a part of the plate-shaped member 55 faces the nozzle peripheral region 67 in the gravity direction Z and a part of the plate-shaped member 55 faces a part of the outer region 68 in the gravity direction Z.

Next, the control portion 39 drives the moving mechanism 28 and the unit driving portion 77 to move the liquid ejecting portion 60 downward and to move the maintenance unit 50 upward, as indicated by white arrows in FIG. 7. That is, the control portion 39 relatively moves the liquid ejecting portion 60 and the maintenance unit 50 so as to approach the gravity direction Z to locate the liquid ejecting portion 60 and the maintenance unit 50 at a maintenance position.

Figure 8:
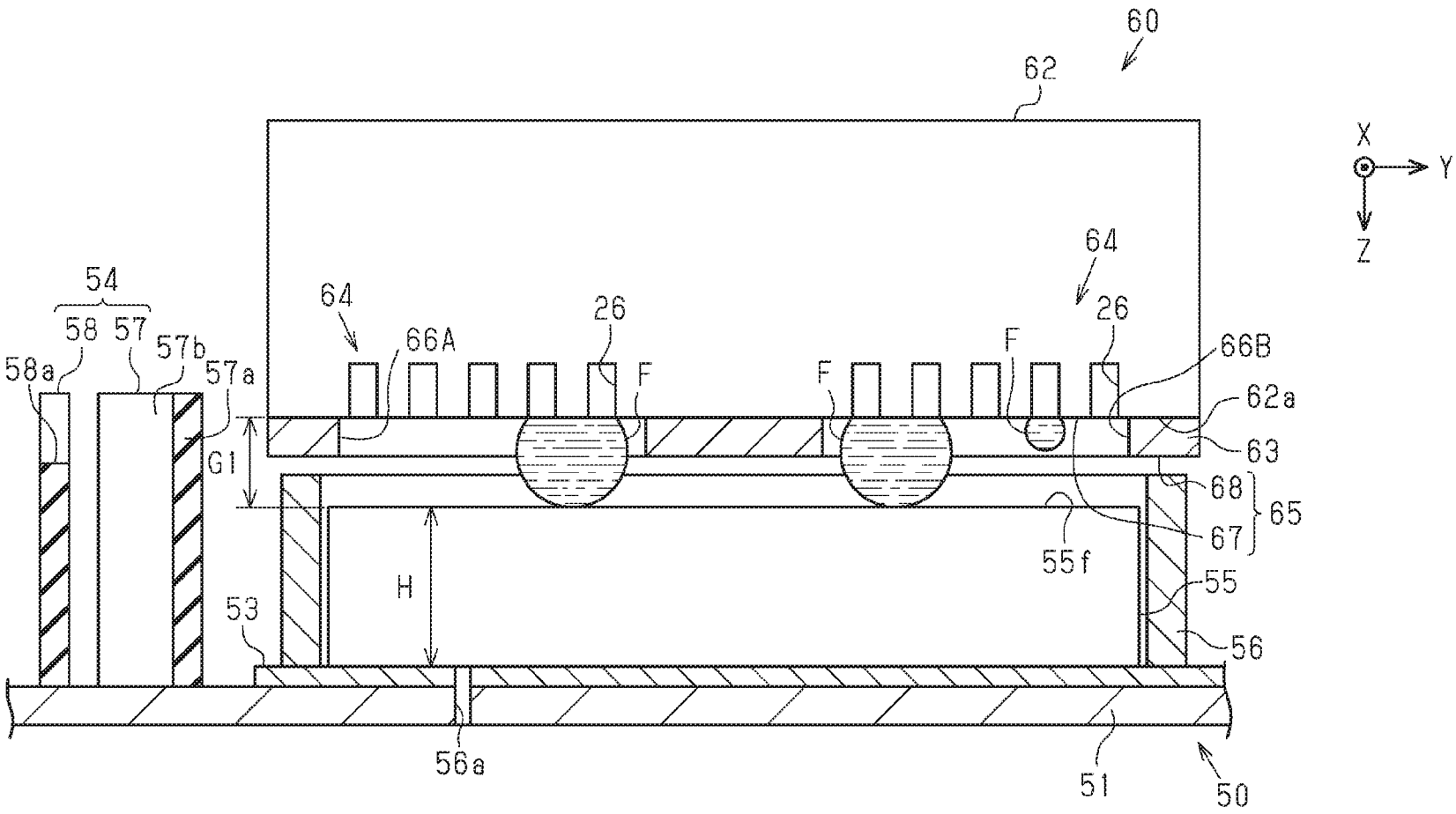
FIG. 8 is a schematic view illustrating a contact operation by a plate-shaped member.

As illustrated in FIG. 8, in the liquid ejecting portion 60 located at the maintenance position, the nozzle peripheral region 67 and the upper end portion 55*f* of the plate-shaped member 55 are away from each other by a maintenance distance G1 in the gravity direction Z. Thus, the control portion 39 relatively moves the plate-shaped member 55 and the liquid ejecting portion 60 so that the upper end portion 55*f* of the plate-shaped member 55 faces the nozzle peripheral region 67 in the gravity direction Z to be away by the maintenance distance G1. In the liquid ejecting portion 60 and the maintenance unit 50 that are located at the maintenance position, the nozzle peripheral region 67 in the nozzle surface 65 including the nozzle 26 and the upper end portion 55*f* of the plate-shaped member 55 are in non-contact with each other. The maintenance distance G1 of the present embodiment is 1 mm. When the liquid ejecting portion 60 and the maintenance unit 50 are located at the maintenance position, the cap 56 faces the cover member 63 and is away from the cover member 63 in the gravity direction Z.

Next, as illustrated in FIG. 8, the control portion 39 controls the pressure adjustment unit 38 while stopping the movement of the liquid ejecting portion 60 and the maintenance unit 50, and adjusts a higher pressure of the liquid supplied to the liquid ejecting portion 60. As a result, the liquid bulges from the nozzle 26 in the nozzle peripheral region 67. The liquid bulging from the nozzle 26 is illustrated as a liquid droplet F. The liquid droplet F bulges so as to hang down from the nozzle 26 toward the gravity direction Z. Since the upper end portion 55*f* of the plate-shaped member 55 faces the nozzle peripheral region 67 in the gravity direction Z, a direction in which the liquid droplet F approaches the upper end portion 55*f* of the plate-shaped member 55 is the gravity direction Z. Therefore, the liquid droplet F hangs down toward the gravity direction Z, and thus is brought closer to the upper end portion 55*f* of the plate-shaped member 55. As the liquid bulges from the nozzle 26, the control portion 39 performs the contact operation.

The maintenance distance G1 is set to be smaller than a dimension between a lower end of the liquid droplet F and the nozzle opening surface 62*a* in the gravity direction Z, the liquid droplet F being formed by the maximum amount of liquid that can be held in the nozzle peripheral region 67. Therefore, the liquid in the nozzle peripheral region 67 that bulges from the nozzle 26 is brought into contact with the plate-shaped member 55 before dropping from the nozzle peripheral region 67.

A height H of the plate-shaped member 55 may be set so that the liquid flowing along the plate-shaped member 55 to a lower end of the plate-shaped member 55 is separated from the liquid droplet F formed on the nozzle opening surface 62*a*. In addition, when the plate-shaped member 55 is brought into contact with the liquid droplet F, the liquid flowing along the plate-shaped member 55 to the lower end of the plate-shaped member 55 and collected on an upper surface of the fixing plate 53 and the liquid in the nozzle 26 are coupled to each other via the plate-shaped member 55, and potential energy of the liquid collected on the upper surface of the fixing plate 53 may be applied to the liquid in the liquid ejecting portion 60. When the potential energy of the liquid collected on the upper surface of the fixing plate 53 is large, a meniscus formed in the nozzle 26 where the liquid droplet F does not bulge may be broken. Therefore, the potential energy of the liquid corresponding to a height obtained by adding the height H of the plate-shaped member 55 to the maintenance distance G1 may be set to be smaller than a meniscus pressure by which the concave meniscus formed in the nozzle 26 is broken. The meniscus pressure in the present embodiment is 3,000 Pa to 5,000 Pa and is substantially 300 mm to 500 mm in terms of hydraulic head pressure, and the height H of the plate-shaped member 55 is substantially 2 mm.

As described above, in the contact state, the liquid bulging from the nozzle 26 and the upper end portion 55*f* of the plate-shaped member 55 are brought into contact with each other in a state where the nozzle peripheral region 67 including the nozzle 26 and the upper end portion 55*f* of the plate-shaped member 55 are in non-contact with each other. The control portion 39 maintains the contact state between the liquid bulging from the nozzle 26 and the upper end portion 55*f* of the plate-shaped member 55 and maintains the contact state for a predetermined time without performing the relative movement on the liquid ejecting portion 60 and the maintenance unit 50. In the present embodiment, the control portion 39 performs the contact operation by maintaining the contact state between the liquid bulging from the nozzle 26 and the upper end portion 55*f* of the plate-shaped member 55 and maintaining the contact state without performing the relative movement on the liquid ejecting portion 60 and the plate-shaped member 55 for a predetermined time.

The plate-shaped member 55 that performs the contact operation is located below the nozzle surface 65 and has a higher lyophilic property than the nozzle surface 65. Therefore, the liquid droplet F flows along the plate-shaped member 55 being in contact with the liquid droplet F while the contact state between the liquid droplet F and the upper end portion 55*f* of the plate-shaped member 55 is maintained for a predetermined time. That is, the liquid droplet F is in contact with the plate-shaped member 55, such that a balance of surface tension is lost and the liquid droplet F easily flows and is drawn to the plate-shaped member 55 having a high lyophilic property. The liquid that is in contact with the upper end portion 55*f* and flows along the surface of the plate-shaped member 55 in the gravity direction Z is discharged to the outside of the maintenance unit 50 from the discharge port 56*a*.

Figure 9:
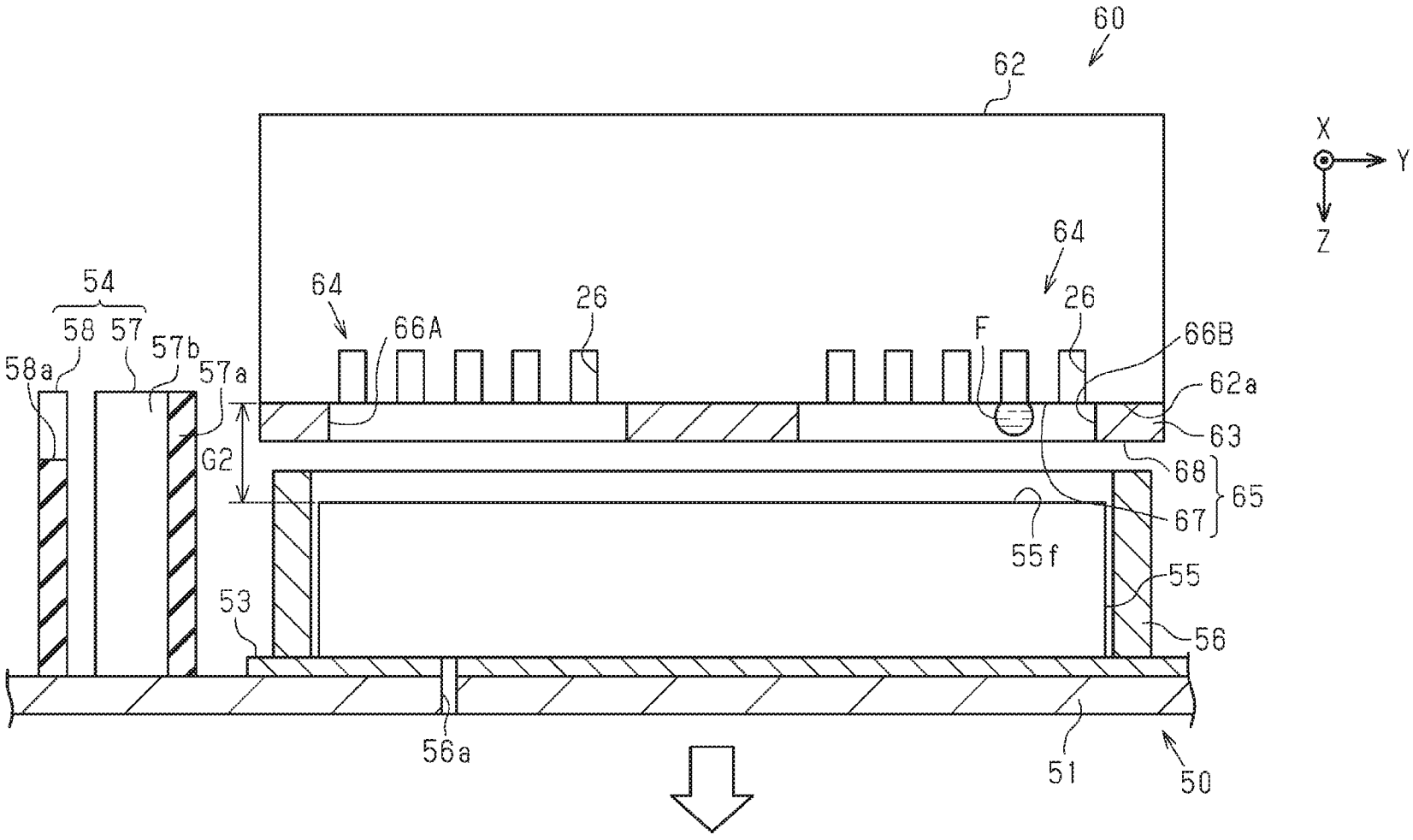
FIG. 9 is a schematic view illustrating operations of the liquid ejecting portion and the plate-shaped member after performing the contact operation.

As illustrated in FIG. 9, the control portion 39 drives the unit driving portion 77 to move the maintenance unit 50 downward as indicated by a white arrow in FIG. 9. At this time, the liquid ejecting portion 60 and the maintenance unit 50 do not move in the intersecting direction X and the wiping direction Y. That is, the plate-shaped member 55 and the liquid ejecting portion 60 relatively move with respect to the nozzle peripheral region 67 so that the upper end portion 55*f* moves away in the gravity direction Z. As such, in the present embodiment, after the contact operation, a separating operation is performed to separate the plate-shaped member 55 and the liquid ejecting portion 60 from each other in the gravity direction Z before performing the wiping operation.

With the separating operation, the liquid ejecting portion 60 and the maintenance unit 50 are located at a wiping position illustrated in FIG. 9. In the liquid ejecting portion 60 located at the wiping position, the nozzle peripheral region 67 and the upper end portion 55*f* of the plate-shaped member 55 are away from each other by a wiping distance G2 in the gravity direction Z. The wiping distance G2 is larger than the maintenance distance G1.

The wiping distance G2 is set to be smaller than the dimension between the lower end of the liquid droplet F and the nozzle opening surface 62*a* in the gravity direction Z, the liquid droplet F formed by the maximum amount of liquid that can be held in the nozzle peripheral region 67. Therefore, the plate-shaped member 55 is separated from the liquid droplet F adhering to the nozzle peripheral region 67 when located at the wiping position.

Figure 10:
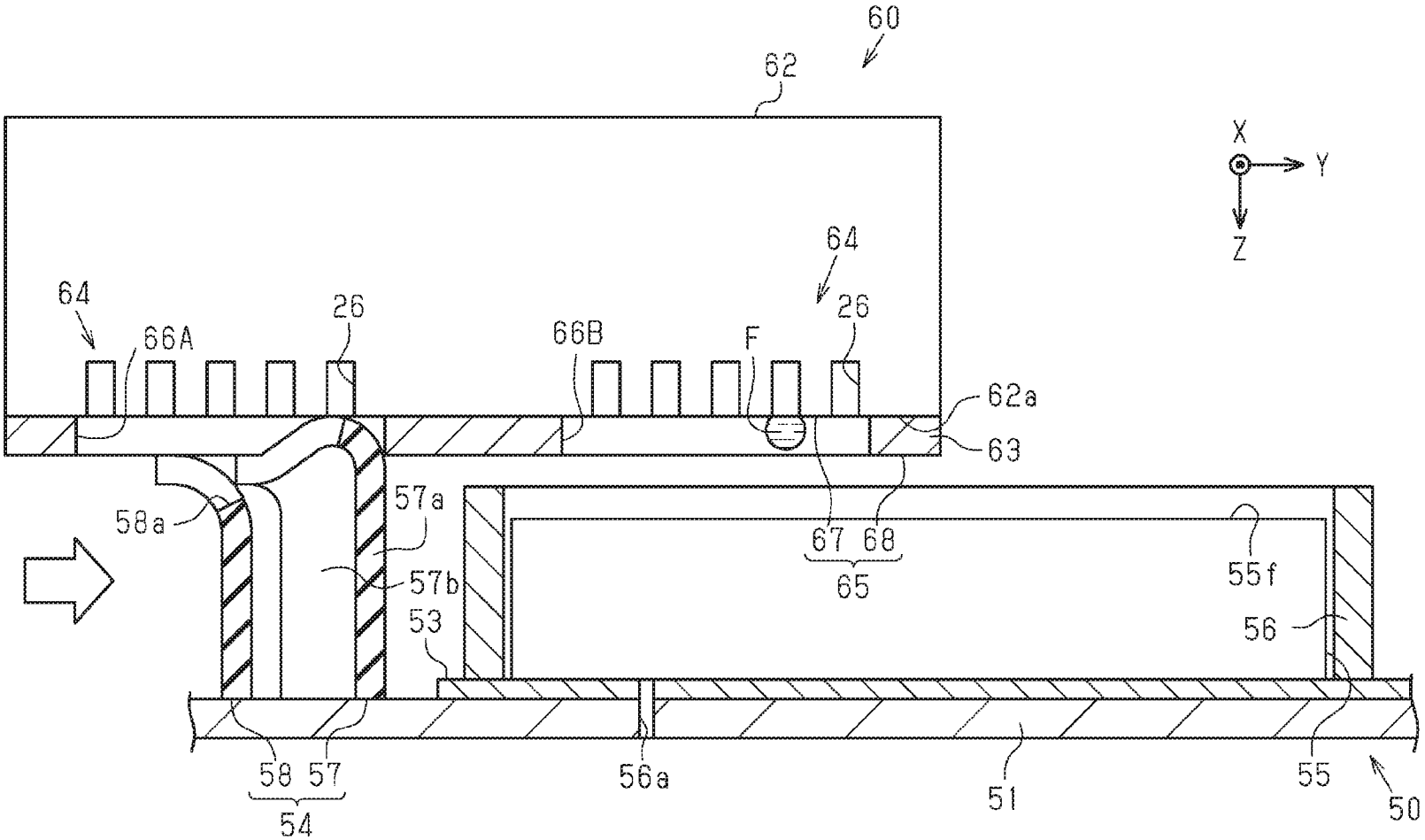
FIG. 10 is a schematic view illustrating a wiping operation by a wiping member.

As illustrated in FIG. 10, the control portion 39 performs the wiping operation of wiping the nozzle surface 65 by relatively moving the wiping member 54 and the liquid ejecting portion 60 in the wiping direction Y along the nozzle surface 65. That is, the control portion 39 drives the electric motor 71 to normally rotate to move the unit holder 75 and the maintenance unit 50 in the wiping direction Y as indicated by a white arrow in FIG. 10.

The control portion 39 performs the wiping operation in a state where the first wiping member 57 is in contact with the nozzle peripheral region 67, and then performs the wiping operation in a state where the second wiping member 58 is in contact with the nozzle surface 65. The plate-shaped member 55 and the wiping member 54 are arranged side by side in the wiping direction Y. The wiping member 54 is located behind the plate-shaped member 55 in the wiping direction Y. The first wiping member 57 of the wiping member 54 is located in front of the second wiping member 58 in the wiping direction Y. In the wiping operation, the control portion 39 moves the maintenance unit 50 in the wiping direction Y, but does not move the liquid ejecting portion 60. In the wiping operation, the control portion 39 relatively moves the wiping member 54 and the liquid ejecting portion 60 in the wiping direction Y along the nozzle surface 65 and wipes the nozzle surface 65 while the plate-shaped member 55 and the nozzle peripheral region 67 are maintained in a state of being separated from each other in the gravity direction Z.

Figure 11:
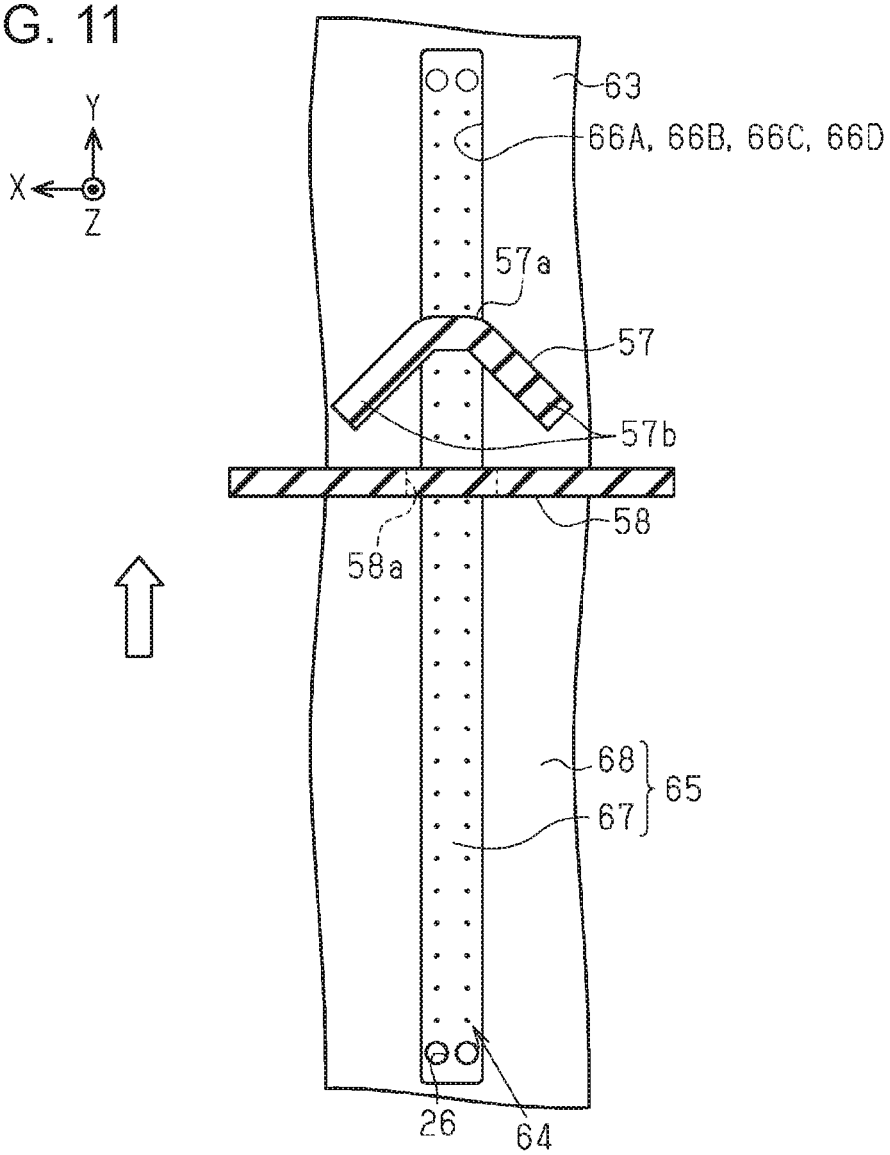
FIG. 11 is an enlarged view illustrating the liquid ejecting portion on which the wiping operation is performed, in a partially enlarged manner.

As illustrated in FIGS. 10 and 11, the wiping operation by the first wiping member 57 is performed in a state where the first wiping member 57 is in contact with the nozzle peripheral region 67. In the wiping operation, the central region 57*a* moves along the nozzle row 64 while being in contact with the nozzle peripheral region 67. With the wiping operation by the first wiping member 57, the liquid adhering to the nozzle peripheral region 67 including the nozzles 26 of the nozzle row 64 moves to the outer region 68 along a surface of the end region 57*b* of the first wiping member 57.

Figure 12:
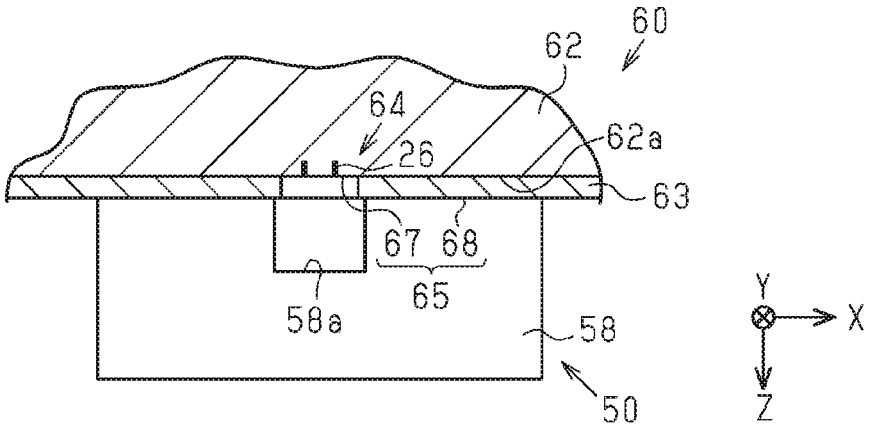
FIG. 12 is a cross-sectional view illustrating the liquid ejecting portion and a second wiping member when the wiping operation is performed.

As illustrated in FIGS. 11 and 12, the wiping operation is performed by the second wiping member 58 following to the wiping operation by the first wiping member 57. In the wiping operation by the second wiping member 58, the second wiping member 58 moves along the outer region 68 with the second wiping member 58 in contact with the outer region 68. With the wiping operation, the liquid that has moved from the nozzle peripheral region 67 to the outer region 68 is removed from the nozzle surface 65. When the wiping operation of the second wiping member 58 is performed, the non-contact region 58*a* does not is brought into contact with the nozzle peripheral region 67.

The two wiping members 54 included in the maintenance unit 50 simultaneously move by the distance of the first length LY which is a distance of a forward movement of the unit holder 75. Due to the movement, one of the two wiping members 54 wipes the nozzle surface 65 including the two nozzle peripheral regions 67 exposed from the cover member 63 through the first through-hole 66A and the second through-hole 66B. The other of the two wiping members 54 wipes the nozzle surface 65 including the two nozzle peripheral regions 67 exposed from the cover member 63 through the third through-hole 66C and the fourth through-hole 66D.

The two second wiping members 58 may have overlapping portions when viewed in the wiping direction Y. By having a portion where the two second wiping members 58 overlap each other, the liquid remaining on the nozzle surface 65 without being wiped by one second wiping member 58 can be wiped by the other second wiping member 58.

When a range for arranging the two second wiping members 58 in the intersecting direction X is larger than the dimension of the nozzle surface 65, the entire nozzle surface 65 can be wiped by the two second wiping members 58. As the nozzle surface 65 is wiped by the second wiping member 58, the liquid on the nozzle surface 65 flows along the surface of the second wiping member 58 in the gravity direction Z. The liquid collected by the wiping operation may be discharged from a discharge port (not illustrated) provided on a bottom surface of the unit hole portion 52 of the unit frame body 51 to the outside of the unit frame body 51.

When the control portion 39 moves the unit holder 75 to the wiping end position indicated by the alternate long and two short dashed line in FIG. 3, the control portion 39 stops driving of the electric motor 71 and ends the wiping operation. After the completion of the wiping operation, the control portion 39 drives the unit driving portion 77 to move the maintenance unit 50 downward. The control portion 39 drives the electric motor 71 to inversely rotate to return the unit holder 75 located at the wiping end position to the wiping start position. The maintenance unit 50 located at the wiping start position faces the liquid ejecting portion 60 in the gravity direction Z as before the contact operation is performed.

Figure 13:
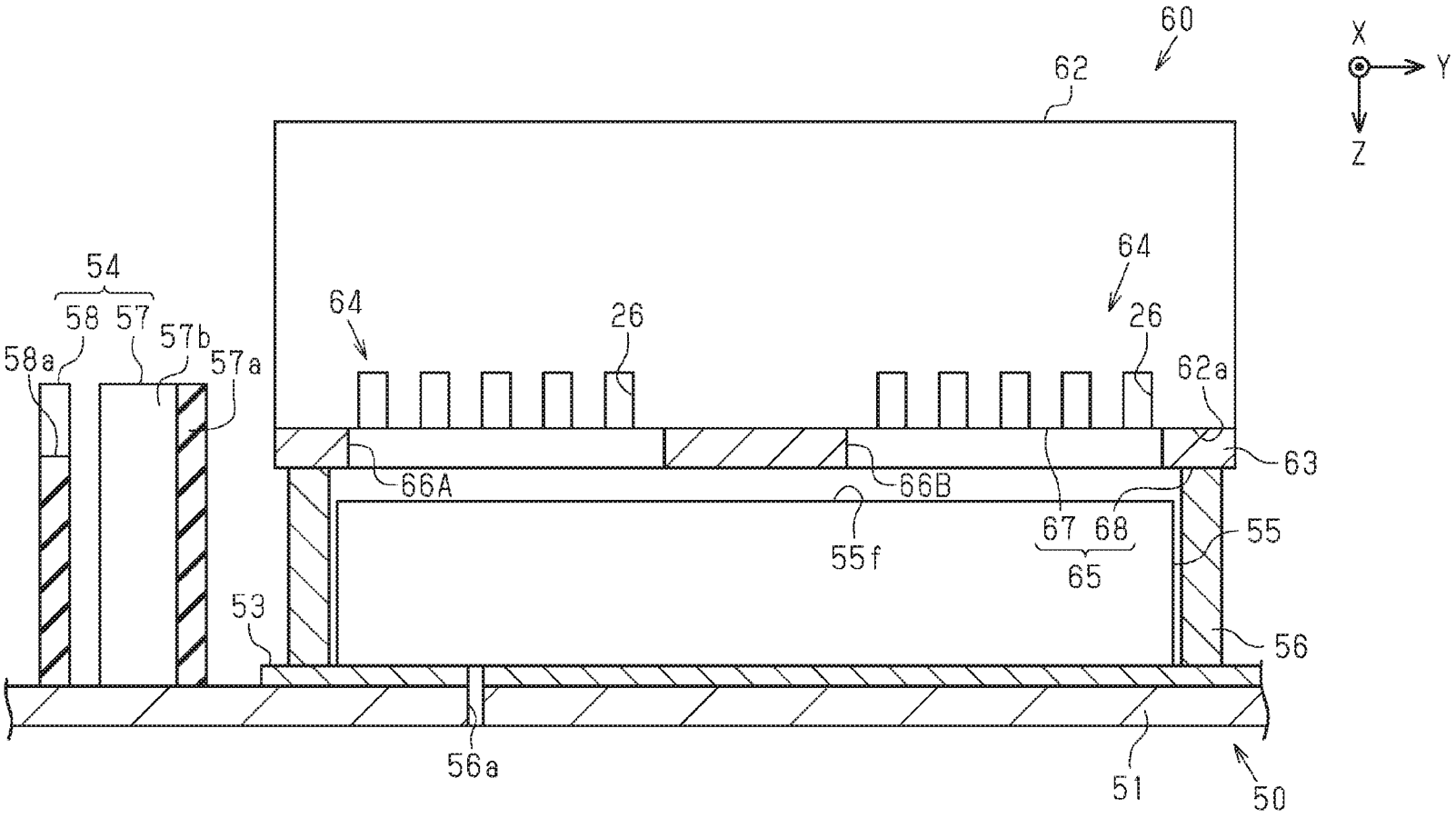
FIG. 13 is a schematic view illustrating a state where the wiping operation is completed.

As illustrated in FIG. 13, the control portion 39 drives at least one of the unit driving portion 77 and the moving mechanism 28 to relatively move the liquid ejecting portion 60 and the maintenance unit 50 in the gravity direction Z, to thereby perform a capping operation. With the capping operation, the liquid ejecting portion 60 and the maintenance unit 50 are located at a capping position. In the capping operation, the control portion 39 may drive the unit driving portion 77 to move the maintenance unit 50 upward, or drive the moving mechanism 28 to move the liquid ejecting portion 60 downward.

A tip end portion of the cap 56 located at the capping position is brought into contact with the outer region 68 of the cover member 63 to form a closed space with the liquid ejecting portion 60. As a result, the liquid in each nozzle 26 can be suppressed to dry.

The effects of the present embodiment will be described.

(1) The control portion 39 performs the contact operation before performing the wiping operation. In the contact operation, the liquid bulging from the nozzle 26 is brought into contact with the upper end portion 55*f* of the plate-shaped member 55 so that a direction in which the liquid bulging from the nozzle 26 is brought closer to the upper end portion 55*f* of the plate-shaped member 55 is the gravity direction Z. The upper end portion 55*f* of the plate-shaped member 55 can be brought into contact with the liquid bulging from the nozzle 26 without performing the relative movement between the liquid ejecting portion 60 and the plate-shaped member 55 in the direction along the nozzle surface 65. Therefore, pressure fluctuation in the liquid ejecting portion 60 can be reduced as compared with a case where the upper end portion 55*f* is brought into contact with the liquid bulging from the nozzle 26 while the liquid ejecting portion 60 and the plate-shaped member 55 relatively move in the direction along the nozzle surface 65.

(2) The control portion 39 relatively moves the plate-shaped member 55 and the liquid ejecting portion 60, and in a state where the upper end portion 55*f* of the plate-shaped member 55 stops at the position facing the nozzle peripheral region 67, the liquid bulges from the nozzle 26. Since the liquid bulging from the nozzle 26 hangs down in the gravity direction Z, the liquid can be brought closer to the plate-shaped member 55 in the gravity direction Z.

(3) In a state where the liquid ejecting portion 60 and the plate-shaped member 55 are not relatively moved by the contact operation, the plate-shaped member 55 may be brought into contact with the liquid bulging from the nozzle 26 even after a predetermined time has elapsed. In this regard, the control portion 39 performs the wiping operation after relatively moving the plate-shaped member 55 and the liquid ejecting portion 60 so that the upper end portion 55*f* moves away from the nozzle peripheral region 67 in the gravity direction Z. Therefore, the pressure fluctuation in the liquid ejecting portion 60 can be reduced as compared with a case where the wiping operation is performed after the plate-shaped member 55 and the liquid ejecting portion 60 are relatively moved in the direction along the nozzle surface 65.

(4) The nozzle peripheral region 67 is surrounded by the outer region 68 protruding from the nozzle peripheral region 67 in the gravity direction Z. The liquid bulging from the nozzle 26 and spreading in the nozzle peripheral region 67 is limited in spreading due to the outer region 68, thereby forming the liquid droplet F in the nozzle peripheral region 67. Therefore, even when the dimension of the upper end portion 55*f* in the intersecting direction X is smaller than the dimension of the nozzle peripheral region 67 in the intersecting direction X, the liquid droplet F and the upper end portion 55*f* can be easily brought into contact with each other. By reducing the dimension of the upper end portion 55*f* in the intersecting direction X, it is possible to stagnate the liquid on the upper end portion 55*f*.

(5) The outer region 68 is formed by the cover member 63 that covers the nozzle forming member 62. The nozzle opening surface 62*a* of the nozzle forming member 62 exposed inside the first through-hole 66A to the fourth through-hole 66D of the cover member 63 is the nozzle peripheral region 67. Thus, the nozzle peripheral region 67 and the outer region 68 protruding from the nozzle peripheral region 67 can be easily formed.

(6) The wiping member 54 has the first wiping member 57 and the second wiping member 58. The control portion 39 reduces an amount of the liquid stagnating in the nozzle peripheral region 67 due to the contact operation, and then wipes the nozzle peripheral region 67 with the first wiping member 57. The liquid that cannot be held by the first wiping member 57 moves to the outer region 68 surrounding the nozzle peripheral region 67 due to the wiping of the first wiping member 57. Therefore, the liquid that has moved to the outer region 68 can be wiped by the second wiping member 58. Since the second wiping member 58 has the non-contact region 58*a* that is not in contact with the nozzle peripheral region 67, it is possible to reduce a risk of wiping the nozzle peripheral region 67 holding the liquid with the second wiping member 58.

(7) The plate-shaped member 55 has a higher lyophilic property than the nozzle peripheral region 67. Therefore, the liquid stagnating in the nozzle peripheral region 67 can easily flow along the plate-shaped member 55 by bringing into contact with the plate-shaped member 55.

(8) The plurality of nozzles 26 communicate with each other in the liquid ejecting portion 60. When the plate-shaped member 55 is brought into contact with the liquid droplet F while relatively moving with the liquid ejecting portion 60 in the direction along the nozzle surface 65, the liquid flowing from a part of the nozzle 26 along the plate-shaped member 55 is drawn, which may cause the liquid adhering to the liquid ejecting portion 60 to be drawn into the liquid ejecting portion 60 from the nozzle 26. In this regard, the upper end portion 55*f* of the plate-shaped member 55 is brought into contact with the liquid bulging from the plurality of nozzles 26 constituting the nozzle row 64 while not performing the relative movement between the liquid ejecting portion 60 and the plate-shaped member 55 in the direction along the nozzle surface 65. Therefore, it can be difficult to capture, in the liquid ejecting portion 60, the liquid in non-contact with the upper end portion 55*f* through the liquid ejecting portion 60, outside air, and foreign matters of the nozzle surface 65 by the liquid under a negative pressure in contact with the upper end portion 55*f*.

The embodiment described above can be modified and implemented as follows. The above-described embodiment and the following modifications can be implemented in combination with each other as long as there is no technical contradiction.

The contact operation may be performed at a position where the upper end portion 55*f* of the plate-shaped member 55 is brought into contact with the outer region 68 of the cover member 63. In the embodiment, the dimension of at least one of the plate-shaped member 55 and the cap 56 in the gravity direction Z is changed, and as a result, the upper end portion 55*f* of the plate-shaped member 55 protrudes upward from the cap 56. Further, the control portion 39 moves the liquid ejecting portion 60 and the maintenance unit 50 so that the maintenance distance G1 between the nozzle peripheral region 67 and the upper end portion 55*f* of the plate-shaped member 55 in the gravity direction Z illustrated in FIG. 8 has the same dimension as the thickness of the cover member 63. By moving the liquid ejecting portion 60 and the maintenance unit 50 as such, in the contact operation illustrated in FIG. 8, the upper end portion 55*f* of the plate-shaped member 55 is brought into contact with the outer region 68 of the cover member 63, and simultaneously, is not brought into contact with the nozzle peripheral region 67 while having a gap corresponding to the thickness of the cover member 63. According to this modification, it is easy to maintain the nozzle peripheral region 67 and the upper end portion 55*f* of the plate-shaped member 55 in a non-contact with each other during the contact operation.

The maintenance operation may not include the capping operation of bringing the tip end portion of the cap 56 into contact with the outer region 68 of the cover member 63 after the wiping operation. After the wiping operation, the control portion 39 may move the liquid ejecting portion 60 in the intersecting direction X to perform flushing on the flushing unit 45, and may perform printing on the medium 13 to be transported in the transport region PA.

The maintenance unit 50 may not include the cap 56. In this case, when the plate-shaped member 55 is brought into contact with the liquid droplet F, the liquid flowing along the plate-shaped member 55 to the lower end of the plate-shaped member 55 and collected on the bottom surface of the unit hole portion 52 and the liquid in the nozzle 26 are coupled to each other via the plate-shaped member 55, and potential energy of the liquid collected on the bottom surface of the unit hole portion 52 may be applied to the liquid in the liquid ejecting portion 60. When the potential energy of the liquid collected on the bottom surface of the unit hole portion 52 is large, a meniscus formed in the nozzle 26 where the liquid droplet F does not bulge may be broken. Therefore, it is preferable that the potential energy of the liquid corresponding to a height obtained by adding the distance from the upper end portion 55*f* of the plate-shaped member 55 to the bottom surface of the unit hole portion 52 in the gravity direction Z to the maintenance distance G1 is set to be smaller than a meniscus pressure by which the concave meniscus formed in the nozzle 26 is broken.

The liquid ejecting apparatus 11 may include a capping mechanism that forms a closed space surrounding the nozzles 26 between the liquid ejecting portions 60 in addition to the cleaning mechanism 47. In this case, for example, the capping mechanism may be arranged at a position between the flushing unit 45 and the cleaning mechanism 47 in the intersecting direction X. The capping mechanism may be provided with the same mechanism as the unit driving portion 77 of the maintenance unit 50 and perform the capping operation, and may include a suction pump capable of sucking the closed space. The capping mechanism includes a plurality of caps corresponding to the first through-hole 66A, the second through-hole 66B, the third through-hole 66C, and the fourth through-hole 66D, and may be brought into contact with the cover member 63 to form a closed space surrounding the nozzle 26 in each of the through-holes. The capping mechanism may include one cap that can is brought into contact with the carriage body 25A to form a closed space surrounding all the nozzles 26 of the liquid ejecting portion 60.

The central region 57*a* of the first wiping member 57 may have a curved plate shape that is curved so as to protrude rearward in the wiping direction Y.

The end region 57*b* may not be inclined with respect to the central region 57*a*, and the entire first wiping member 57 from the central region 57*a* to the end region 57*b* may have a flat plate shape.

The fifth width W5 of the non-contact region 58*a* in the second wiping member 58 may be the same as the second width W2 of each of the first through-hole 66A to the fourth through-hole 66D, or may be smaller than the second width W2 of each of the first through-hole 66A to the fourth through-hole 66D. In conclusion, the fifth width W5 may be larger than the third width W3 of the plate-shaped member 55.

The overall shape of the second wiping member 58 may be a rectangular flat plate shape by omitting the non-contact region 58*a* from the second wiping member 58.

The wiping direction Y may be a direction from the downstream to the upstream in the transport direction Y1, or may be a direction from the upstream to the downstream in the transport direction Y1. The wiping direction Y may be the same as the intersecting direction X, or may be the same as a direction opposite to the intersecting direction X. When the wiping member 54 is arranged at the upstream of the plate-shaped member 55 in the wiping direction Y, the wiping operation can be easily performed after the contact operation.

The wiping member 54 may have any one of the first wiping member 57 and the second wiping member 58. For example, when the wiping member 54 has only the second wiping member 58, the second wiping member 58 may be brought into contact with the nozzle peripheral region 67. When the wiping member 54 has only the first wiping member 57, the first wiping width W11 of the first wiping member 57 in the intersecting direction X may have the same dimension as the second wiping width W12. The liquid ejecting apparatus 11 may have three or more wiping members 54 such as a third wiping member added to the first wiping member 57 and the second wiping member 58.

The wiping member 54 may be made of a material other than a rubber member. Examples of the material of the wiping member 54 include a resin member, a resin elastomer having elasticity, and a cloth member. Examples of the resin elastomer include a silicone elastomer.

The third width W3 of the upper end portion 55*f* of the plate-shaped member 55 in the intersecting direction X may be larger than the second width W2 of each of the first through-hole 66A to the fourth through-hole 66D. In the embodiment, the third width W3 of the upper end portion 55*f* of the plate-shaped member 55 in the intersecting direction X is larger than the dimension of the nozzle peripheral region 67 in the intersecting direction X.

The plate-shaped member 55 may be subjected to a liquid-repellent treatment.

The plate-shaped member 55 may be made of resin or rubber. In conclusion, the plate-shaped member 55 may be a nonabsorbent member that does not absorb a liquid.

The upper end portion 55*f* of the plate-shaped member 55 may have a curved surface that is curved so as to protrude upward in the gravity direction Z.

The liquid ejecting apparatus 11 may include four plate-shaped members 55 so as to correspond to the first through-hole 66A to the fourth through-hole 66D in an individual manner. In the contact operation, each plate-shaped member 55 may face the corresponding nozzle peripheral region 67 among the nozzle peripheral regions 67 exposed from the first through-hole 66A to the fourth through-hole 66D.

In the maintenance unit 50, the plate-shaped member 55 and the wiping member 54 may be movable independently.

In the separating operation, the control portion 39 may move the liquid ejecting portion 60 upward in the gravity direction Z, or may separately move the liquid ejecting portion 60 and the plate-shaped member 55 from each other in the gravity direction Z. In conclusion, in the separating operation, the control portion 39 may relatively move the plate-shaped member 55 and the liquid ejecting portion 60 so that the upper end portion 55*f* of the plate-shaped member 55 moves away from the nozzle peripheral region 67 in the gravity direction Z.

The control portion 39 may perform the wiping operation without performing the separating operation after performing the contact operation.

In the contact operation, the control portion 39 moves at least one of the liquid ejecting portion 60 and the plate-shaped member 55 along the Z axis, such that the liquid bulging from the nozzle 26 may be brought into contact with the upper end portion 55*f*. That is, the control portion 39 may move the liquid ejecting portion 60 downward, or may move the plate-shaped member 55 upward. Also in the embodiment, the liquid bulging from the nozzle 26 is brought into contact with the upper end portion 55*f* so that a direction in which the liquid bulging from the nozzle 26 is brought closer to the upper end portion 55*f* is the gravity direction Z.

The wiping operation may be performed by moving the liquid ejecting portion 60 without moving the wiping member 54, or may be performed by moving both of the wiping member 54 and the liquid ejecting portion 60. In conclusion, the wiping operation may be performed as long as the wiping member 54 and the liquid ejecting portion 60 are relatively moved in the wiping direction along the nozzle surface 65.

The liquid repellency of the outer region 68 forming the nozzle surface 65 may be lower than that of the nozzle peripheral region 67, or the surface of the cover member 63 forming the outer region 68 may not be subjected to the liquid-repellent treatment. Also in this case, it is preferable that the contact angle formed by the surface of the liquid and the surface of the plate-shaped member 55 when the plate-shaped member 55 is brought into contact with the liquid is smaller than a contact angle formed by the surface of the liquid and the surface of the nozzle peripheral region 67 when the nozzle peripheral region 67 is brought into contact with the liquid.

The liquid ejecting portion 60 may not include the cover member 63. The nozzle surface 65 may be a flat surface formed by the nozzle opening surface 62*a*. When the nozzle surface 65 is a flat surface, the entire nozzle opening surface 62*a* may be the nozzle peripheral region 67. In the nozzle forming member 62, the nozzle opening surface 62*a* may be formed in an uneven shape. For example, the nozzle opening surface 62*a* may surround the nozzle 26 by a protruding surface. In this case, the region surrounded by the protruding surface is the nozzle peripheral region 67 formed by the nozzle 26, and the protruding surface is the outer region 68.

One nozzle row 64 may be located in each nozzle peripheral region 67 exposed from the first through-hole 66A to the fourth through-hole 66D.

The control portion 39 may cause the liquid to bulge from the nozzle 26 by pressurizing the liquid supplied to the liquid ejecting portion 60 by the operation of the supply pump 34, instead of the pressure adjustment unit 38. The control portion 39 may cause the pressurized liquid to bulge from the nozzle 26 due to the operations of the pressure adjustment unit 38 and the supply pump 34.

The control portion 39 may drive the actuator provided in the liquid ejecting portion 60 in a state where the liquid bulges from the nozzle 26. As a result, improvement in a recovery efficiency due to the contact operation of the foreign matters adhered inside the nozzle 26 or in the nozzle peripheral region 67 can be expected.

The liquid used in the above-described embodiment may be pigment ink containing a solvent as a main solvent or aqueous dye ink. For example, when the wiping operation is performed with the foreign matters such as a thickened liquid component or a solidified liquid component adhered to the nozzle peripheral region 67 even when the liquid does not contain the pigment, the nozzle surface 65 may be damaged. In this regard, by performing the contact operation before the wiping operation, the foreign matters adhered to the nozzle peripheral region 67 can be washed away, and thus the wiping operation can be performed while reducing the damage to the nozzle surface 65.

In the above-described embodiment, the liquid ejecting apparatus 11 is not limited to a so-called serial head type liquid ejecting apparatus in which the liquid ejecting portion 60 ejects the liquid while moving in the intersecting direction X and printing is performed on the stopped medium 13. The liquid ejecting apparatus 11 may be a line head type liquid ejecting apparatus in which the liquid ejecting portion 60 is provided across the width direction of the medium 13, the liquid is ejected from the liquid ejecting portion 60 to the stopped medium 13 to be transported, and printing is performed on the medium 13.

In the above-described embodiment, the liquid ejecting apparatus 11 may be a liquid ejecting apparatus that ejects or discharges a liquid other than ink. Examples of the liquid other than the ink include liquids, sol, gel water, other inorganic solvents, an organic solvent, a solution, liquid resin, and fluids such as liquid metal. Further, examples of the liquid other than the ink include not only the liquid as one state of a substance but also particles of a functional material formed of a solid matter such as a pigment or metal particles being dissolved, dispersed or mixed in a solvent. Typical examples of the liquid include various liquid compositions such as aqueous ink, non-aqueous ink, oil-based ink, gel ink, hot-melt ink, and liquid crystals, as described in the embodiment. Specific examples of the liquid ejecting apparatus include a liquid ejecting apparatus that ejects the liquid containing a material such as an electrode material or a coloring material used in manufacturing, for example, a liquid crystal display, an electroluminescence (EL) display, a surface light emission display, and a color filter, in a dispersed or dissolved state. Further, specific examples of the liquid ejecting apparatus may include a liquid ejecting apparatus that ejects a bio-organic matter used in manufacturing a biochip, a liquid ejecting apparatus that ejects a sample liquid used as a precision pipette, a fabric printing apparatus, a micro dispenser, or the like. Further, specific examples of the liquid ejecting apparatus may include a liquid ejecting apparatus that ejects a lubricating oil to a precision instrument such as a timepiece or a camera with a pin point, and a liquid ejecting apparatus that ejects, onto a substrate, a transparent resin liquid such as an ultraviolet curable resin for forming a micro semispherical lens (optical lens) used for an optical communication element and the like. Further, specific examples of the liquid ejecting apparatus may include a liquid ejecting apparatus that ejects an etchant such as acid or alkali for etching a substrate or the like.

Technical ideas that can be derived from the above-described embodiment and modifications and their functions and effects will be described below.

(A) A liquid ejecting apparatus includes: a liquid ejecting portion configured to eject a liquid to be supplied from a plurality of nozzles that are arranged on a nozzle surface to form a nozzle row; a plate-shaped member having an upper end portion of which a dimension in a direction in which the nozzle row extends is equal to or larger than that of the nozzle row; a wiping member configured to wipe the nozzle surface; and a control portion, in which the control portion performs a contact operation of bringing the liquid bulging from the nozzle into contact with the upper end portion so that a direction in which the liquid bulging from the nozzle is brought closer to the upper end portion is a gravity direction in a state where a nozzle peripheral region including the nozzles on the nozzle surface is not in contact with the upper end portion, and maintaining the contact state between the liquid bulging from the nozzle and the upper end portion for a predetermined time without relatively moving the liquid ejecting portion and the plate-shaped member, and performs a wiping operation of wiping the nozzle surface after the contact operation by relatively moving the wiping member and the liquid ejecting portion in a wiping direction along the nozzle surface.

According to this configuration, the control portion performs the contact operation before performing the wiping operation. In the contact operation, the liquid bulging from the nozzle is brought into contact with the upper end portion of the plate-shaped member so that the direction in which the liquid bulging from the nozzle approaches the upper end portion of the plate-shaped member is the gravity direction. Bringing the liquid bulging from the nozzle into contact with the upper end portion so that the direction in which the liquid bulging from the nozzle approaches the upper end portion of the plate-shaped member is the gravity direction can be realized by performing at least one method of moving the liquid ejecting portion in the gravity direction, moving the plate-shaped member in a direction opposite to the gravity direction, and hanging down the liquid bulging from the nozzle in the gravity direction. In other words, the upper end portion of the plate-shaped member can be brought into contact with the liquid bulging from the nozzle without performing the relative movement between the liquid ejecting portion and the plate-shaped member in the direction along the nozzle surface. Therefore, pressure fluctuation in the liquid ejecting portion can be reduced as compared with a case where the upper end portion is brought into contact with the liquid bulging from the nozzle while the liquid ejecting portion and the plate-shaped member relatively move in the direction along the nozzle surface.

(B) In the liquid ejecting apparatus, the control portion may perform the contact operation by causing the liquid to bulge from the nozzle after relatively moving the plate-shaped member and the liquid ejecting portion so that the upper end portion faces the nozzle peripheral region in the gravity direction.

According to this configuration, the control portion relatively moves the plate-shaped member and the liquid ejecting portion and causes the liquid to bulge from the nozzle in a state where the upper end portion of the plate-shaped member is stopped at a position facing the nozzle peripheral region. Since the liquid bulging from the nozzle hangs down in the gravity direction, the liquid can approach the gravity direction with respect to the plate-shaped member.

(C) In the liquid ejecting apparatus, the control portion may perform the wiping operation after performing the contact operation and relatively moving the plate-shaped member and the liquid ejecting portion so that the upper end portion moves away from the nozzle peripheral region in the gravity direction.

In a state where the liquid ejecting portion and the plate-shaped member are not relatively moved by the contact operation, the plate-shaped member may be brought into contact with the liquid bulging from the nozzle even after a predetermined time has elapsed. In this regard, according to this configuration, the control portion performs the wiping operation after relatively moving the plate-shaped member and the liquid ejecting portion so that the upper end portion moves away from the nozzle peripheral region in the gravity direction. Therefore, the pressure fluctuation in the liquid ejecting portion can be reduced as compared with a case where the wiping operation is performed after the plate-shaped member and the liquid ejecting portion are relatively moved in the direction along the nozzle surface.

(D) In the liquid ejecting apparatus, the nozzle surface may have the nozzle peripheral region and an outer region surrounding the nozzle peripheral region, the outer region being a protruding surface protruding from the nozzle peripheral region in the gravity direction, and a dimension of the upper end portion in an intersecting direction intersecting with the nozzle row may be smaller than a dimension of the nozzle peripheral region in the intersecting direction.

According to this configuration, the nozzle peripheral region is surrounded by the outer region protruding from the nozzle peripheral region in the gravity direction. The liquid bulging from the nozzle and spreading in the nozzle peripheral region is limited in spreading due to the outer region, thereby forming the liquid droplet in the nozzle peripheral region. Therefore, even when the dimension of the upper end portion in the intersecting direction is smaller than the dimension of the nozzle peripheral region in the intersecting direction, the liquid droplet and the upper end portion can be easily brought into contact with each other. By reducing the dimension of the upper end portion in the intersecting direction, it is possible to stagnate the liquid on the upper end portion.

(E) In the liquid ejecting apparatus, the outer region may be formed by a cover member covering a nozzle forming member in which the nozzles are formed, and the cover member may have a through-hole for exposing the nozzle peripheral region.

According to this configuration, the outer region is formed by the cover member covering the nozzle forming member, and a portion of the nozzle forming member exposed inside the through-hole of the cover member is the nozzle peripheral region. Thus, the nozzle peripheral region and the outer region protruding from the nozzle peripheral region can be easily formed.

(F) In the liquid ejecting apparatus, the wiping direction may be a direction along the nozzle row, the wiping member may include a first wiping member having a dimension in an intersecting direction intersecting with the nozzle row larger than that of the nozzle peripheral region and a second wiping member having a dimension in the intersecting direction larger than that of the first wiping member, the first wiping member may have a central region bringing into contact with the nozzle peripheral region during the wiping operation and an end region located at an end in the intersecting direction from the central region, and the central region may protrude forward from the end region in the wiping direction, the second wiping member may have a non-contact region not bringing into contact with the nozzle peripheral region during the wiping operation, and a dimension of the non-contact region in the intersecting direction may be larger than a dimension of the upper end portion, and the control portion may perform the wiping operation in a state where the first wiping member is in contact with the nozzle peripheral region, and then perform the wiping operation in a state where the second wiping member is in contact with the nozzle surface.

According to this configuration, the wiping member has the first wiping member and the second wiping member. The control portion reduces an amount of the liquid stagnating in the nozzle peripheral region due to the contact operation, and then wipes the nozzle peripheral region with the first wiping member. The liquid that cannot be held by the first wiping member moves to the outer region surrounding the nozzle peripheral region due to the wiping of the first wiping member. Therefore, the liquid that has moved to the outer region can be wiped by the second wiping member. Since the second wiping member has the non-contact region that is not in contact with the nozzle peripheral region, it is possible to reduce a risk of wiping the nozzle peripheral region holding the liquid with the second wiping member.

(G) In the liquid ejecting apparatus, a contact angle formed by a surface of the liquid and a surface of the plate-shaped member when the plate-shaped member is brought into contact with the liquid may be smaller than a contact angle formed by the surface of the liquid and a surface of the nozzle peripheral region when the nozzle peripheral region is brought into contact with the liquid.

According to this configuration, the plate-shaped member has a higher lyophilic property than the nozzle peripheral region. Therefore, the liquid stagnating in the nozzle peripheral region can easily flow along the plate-shaped member by bringing into contact with the plate-shaped member.

(H) A maintenance method of a liquid ejecting apparatus including a liquid ejecting portion configured to eject a liquid to be supplied from a plurality of nozzles that are arranged on a nozzle surface to form a nozzle row, a plate-shaped member having an upper end portion of which a dimension in a direction in which the nozzle row extends is equal to or larger than that of the nozzle row, and a wiping member configured to wipe the nozzle surface, the maintenance method including: performing a contact operation of bringing the liquid bulging from the nozzle into contact with the upper end portion so that a direction in which the liquid bulging from the nozzle is brought closer to the upper end portion is a gravity direction in a state where a nozzle peripheral region including the nozzles on the nozzle surface is not in contact with the upper end portion, and maintaining the contact state between the liquid bulging from the nozzle and the upper end portion for a predetermined time without relatively moving the liquid ejecting portion and the plate-shaped member; and performing a wiping operation of wiping the nozzle surface after the contact operation by relatively moving the wiping member and the liquid ejecting portion in a wiping direction along the nozzle surface. According to this method, the same effect as that of the liquid ejecting apparatus can be achieved.

(I) In the maintenance method of a liquid ejecting apparatus, the contact operation may be performed by causing the liquid to bulge from the nozzle after relatively moving the plate-shaped member and the liquid ejecting portion so that the upper end portion faces the nozzle peripheral region in the gravity direction. According to this method, the same effect as that of the liquid ejecting apparatus can be achieved.

(J) In the maintenance method of a liquid ejecting apparatus, the wiping operation may be performed after performing the contact operation and relatively moving the plate-shaped member and the liquid ejecting portion so that the upper end portion moves away from the nozzle peripheral region in the gravity direction. According to this method, the same effect as that of the liquid ejecting apparatus can be achieved.

What is claimed is:

1. A liquid ejecting apparatus comprising:

a liquid ejecting portion configured to eject a liquid from a plurality of nozzles that are arranged on a nozzle surface and forms a nozzle row;

a plate-shaped member having an upper end portion of which a dimension in a direction in which the nozzle row extends is equal to or larger than that of the nozzle row;

a wiping member configured to wipe the nozzle surface; and a control portion, wherein the control portion performs a contact operation of bringing the liquid bulging from the nozzle into contact with the upper end portion in a state where a nozzle peripheral region including the nozzles on the nozzle surface is not in contact with the upper end portion, and maintaining the contact state between the liquid bulging from the nozzle and the upper end portion for a predetermined time without relatively moving the liquid ejecting portion and the plate-shaped member, and performs a wiping operation of wiping the nozzle surface after the contact operation by relatively moving the wiping member and the liquid ejecting portion in a wiping direction along the nozzle surface.

2. The liquid ejecting apparatus according to claim 1, wherein the control portion performs the contact operation by causing the liquid to bulge from the nozzle after relatively moving the plate-shaped member and the liquid ejecting portion so that the upper end portion faces the nozzle peripheral region in a gravity direction.

3. The liquid ejecting apparatus according to claim 2, wherein the control portion performs the wiping operation after performing the contact operation and relatively moving the plate-shaped member and the liquid ejecting portion so that the upper end portion moves away from the nozzle peripheral region in the gravity direction.

4. The liquid ejecting apparatus according to claim 1, wherein the nozzle surface has the nozzle peripheral region and an outer region surrounding the nozzle peripheral region, the outer region being a protruding surface protruding from the nozzle peripheral region in the gravity direction, and a dimension of the upper end portion in an intersecting direction intersecting with the nozzle row is smaller than a dimension of the nozzle peripheral region in the intersecting direction.

5. The liquid ejecting apparatus according to claim 4, wherein the outer region is formed by a cover member covering a nozzle forming member in which the nozzles are formed, and the cover member has a through-hole for exposing the nozzle peripheral region.

6. The liquid ejecting apparatus according to claim 1, wherein the wiping direction is a direction along the nozzle row, the wiping member includes a first wiping member having a dimension in an intersecting direction intersecting with the nozzle row larger than that of the nozzle peripheral region, and a second wiping member having a dimension in the intersecting direction larger than that of the first wiping member, the first wiping member has a central region bringing into contact with the nozzle peripheral region during the wiping operation and an end region located at an end in the intersecting direction from the central region, and the central region protrudes forward from the end region in the wiping direction, the second wiping member has a non-contact region not bringing into contact with the nozzle peripheral region during the wiping operation, and a dimension of the non-contact region in the intersecting direction is larger than a dimension of the upper end portion, and the control portion performs the wiping operation in a state where the first wiping member is in contact with the nozzle peripheral region, and then performs the wiping operation in a state where the second wiping member is in contact with the nozzle surface.

7. The liquid ejecting apparatus according to claim 1, wherein a contact angle formed by a surface of the liquid and a surface of the plate-shaped member when the plate-shaped member is brought into contact with the liquid is smaller than a contact angle formed by the surface of the liquid and a surface of the nozzle peripheral region when the nozzle peripheral region is brought into contact with the liquid.

8. A maintenance method of a liquid ejecting apparatus including a liquid ejecting portion configured to eject a liquid from a plurality of nozzles that are arranged on a nozzle surface and forms a nozzle row, a plate-shaped member having an upper end portion of which a dimension in a direction in which the nozzle row extends is equal to or larger than that of the nozzle row, and a wiping member configured to wipe the nozzle surface, the maintenance method comprising:

performing a contact operation of bringing the liquid bulging from the nozzle into contact with the upper end portion in a state where a nozzle peripheral region including the nozzles on the nozzle surface is not in contact with the upper end portion, and maintaining the contact state between the liquid bulging from the nozzle and the upper end portion for a predetermined time without relatively moving the liquid ejecting portion and the plate-shaped member; and performing a wiping operation of wiping the nozzle surface after the contact operation by relatively moving the wiping member and the liquid ejecting portion in a wiping direction along the nozzle surface.

9. The maintenance method of a liquid ejecting apparatus according to claim 8, wherein the contact operation is performed by causing the liquid to bulge from the nozzle after relatively moving the plate-shaped member and the liquid ejecting portion so that the upper end portion faces the nozzle peripheral region in a gravity direction.

10. The maintenance method of a liquid ejecting apparatus according to claim 9, wherein the wiping operation is performed after performing the contact operation and relatively moving the plate-shaped member and the liquid ejecting portion so that the upper end portion moves away from the nozzle peripheral region in the gravity direction.

* * * * *